US011898407B2

(12) United States Patent
Mikalsen et al.

(10) Patent No.: US 11,898,407 B2
(45) Date of Patent: Feb. 13, 2024

(54) STABBING GUIDE FOR A ROBOTIC ROUGHNECK

(71) Applicant: Canrig Robotic Technologies AS, Sandnes (NO)

(72) Inventors: Kenneth Mikalsen, Sandnes (NO); Svein Søyland, Kvernaland (NO)

(73) Assignee: Nabors Drilling Technologies USA, Inc., Houston, TX (US)

( * ) Notice: Subject to any disclaimer, the term of this patent is extended or adjusted under 35 U.S.C. 154(b) by 205 days.

(21) Appl. No.: 17/444,867

(22) Filed: Aug. 11, 2021

(65) Prior Publication Data

US 2022/0065054 A1 Mar. 3, 2022

Related U.S. Application Data

(60) Provisional application No. 63/072,707, filed on Aug. 31, 2020.

(51) Int. Cl.
*E21B 19/24* (2006.01)
*E21B 19/16* (2006.01)

(52) U.S. Cl.
CPC ..... *E21B 19/24* (2013.01); *E21B 19/165* (2013.01)

(58) Field of Classification Search
CPC ..... E21B 19/24; E21B 19/16–168
See application file for complete search history.

(56) References Cited

U.S. PATENT DOCUMENTS

| | | | | |
|---|---|---|---|---|
| 4,765,401 | A | 8/1988 | Boyadjieff | |
| 7,114,235 | B2 | 10/2006 | Jansch et al. | |
| 10,337,263 | B2 | 7/2019 | Pratt et al. | |
| 10,494,883 | B2 | 12/2019 | Macpherson et al. | |
| 10,619,431 | B2 | 4/2020 | Vestersjo et al. | |
| 10,648,255 | B2 | 5/2020 | Thiemann et al. | |
| 2004/0049905 | A1* | 3/2004 | Jansch | E21B 19/164 29/428 |
| 2010/0199812 | A1 | 8/2010 | Richardson | |
| 2015/0176349 | A1 | 6/2015 | Belik | |
| 2016/0186510 | A1* | 6/2016 | Vestersjo | E21B 19/00 166/380 |
| 2019/0136669 | A1 | 5/2019 | Wiedecke et al. | |

FOREIGN PATENT DOCUMENTS

| | | | |
|---|---|---|---|
| EP | 3030742 | B1 | 1/2018 |
| WO | 2017/100913 | A1 | 6/2017 |

OTHER PUBLICATIONS

International Search Report from PCT Application No. PCT/EP2021/073073, dated Nov. 4, 2021, 1 pg.

* cited by examiner

*Primary Examiner* — Kristyn A Hall
(74) *Attorney, Agent, or Firm* — Abel Schillinger, LLP

(57) ABSTRACT

A system including a stabbing guide with a plurality of guide elements, an engaging element, and a linkage assembly that couples the plurality of guide elements to the engaging element, where rotation of the engaging element relative to the plurality of guide elements drives the linkage assembly and, via the linkage assembly, moves the guide elements radially relative to a center axis of the stabbing guide.

20 Claims, 21 Drawing Sheets

STABBING GUIDE FOR A ROBOTIC ROUGHNECK

CROSS-REFERENCE TO RELATED APPLICATION(S)

This application claims priority under 35 U.S.C. § 119(e) to U.S. Patent Application No. 63/072,707, entitled "STABBING GUIDE FOR A ROBOTIC ROUGHNECK," by Kenneth MIKALSEN et al., filed Aug. 31, 2020, which application is assigned to the current assignee hereof and incorporated herein by reference in its entirety.

TECHNICAL FIELD

The present invention relates, in general, to the field of drilling and processing of wells. More particularly, present embodiments relate to a system and method for manipulating tubulars during subterranean operations.

BACKGROUND

Robots can assist operators when performing subterranean operations, such as drilling wellbores, casing wellbores, wellbore testing, etc., that may utilize a segmented tubular string extending in the wellbore. The robots, such as pipe handlers, can handle tubulars to present the tubulars to a well center of a rig for connection to a tubular string (such as when the tubular string is being tripped into the wellbore) or handle tubulars to retrieve them from the well center of the rig when connections to the tubular string are broken (such as when the tubular string is being tripped out of the wellbore). As connections are made, the robots may assist operators (or autonomously control equipment) to guide the next tubular onto a stickup at well center during a tripping in operation, spinning the tubular onto the stickup, and torqueing the tubular joint created when the tubular was threadably connected to the stickup. However, improvements in robotic systems are continually needed to increase efficiencies in subterranean operations.

SUMMARY

One general aspect of the current disclosure includes a system for performing a subterranean operation which can include a stabbing guide with a plurality of guide elements, an engaging element, and a linkage assembly that couples the plurality of guide elements to the engaging element, where rotation of the engaging element relative to the plurality of guide elements can drive the linkage assembly and, via the linkage assembly, move the guide elements radially relative to a center axis of the stabbing guide.

Another general aspect can include a system for performing a subterranean operation that can include an iron roughneck with a torque wrench and a backup tong; a stabbing guide that may include a plurality of guide elements, an engaging element, and a linkage assembly that couples the plurality of guide elements to the engaging element, where rotation of the torque wrench selectively can engage the engaging element and rotate the engaging element relative to the plurality of guide elements, and where rotation of the engaging element can drive the linkage assembly and, via the linkage assembly and move the guide elements radially relative to a center axis of the stabbing guide.

Another general aspect can include a method for performing a subterranean operation that can include operations of moving a tubular into an opening in a torque wrench of an iron roughneck; rotating the torque wrench, thereby activating a stabbing guide; engaging the tubular with a plurality of guide elements of the stabbing guide in response to rotating the torque wrench; and moving the plurality of guide elements radially inward toward a center axis of the stabbing guide a radial distance that is proportional to a distance of rotation of the torque wrench.

BRIEF DESCRIPTION OF THE DRAWINGS

These and other features, aspects, and advantages of present embodiments will become better understood when the following detailed description is read with reference to the accompanying drawings in which like characters represent like parts throughout the drawings, wherein.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

The use of the word "about", "approximately", or "substantially" is intended to mean that a value of a parameter is close to a stated value or position. However, minor differences may prevent the values or positions from being exactly as stated. Thus, differences of up to ten percent (10%) for the value are reasonable differences from the ideal goal of exactly as described. A significant difference can be when the difference is greater than ten percent (10%).

As used herein, "tubular" refers to an elongated cylindrical tube and can include any of the tubulars manipulated around a rig, such as tubular segments, tubular stands, tubulars, and tubular string. Therefore, in this disclosure, "tubular" is synonymous with "tubular segment," "tubular stand," and "tubular string," as well as "pipe," "pipe segment," "pipe stand," "pipe string," "casing," "casing segment," or "casing string."

Figure 1A:
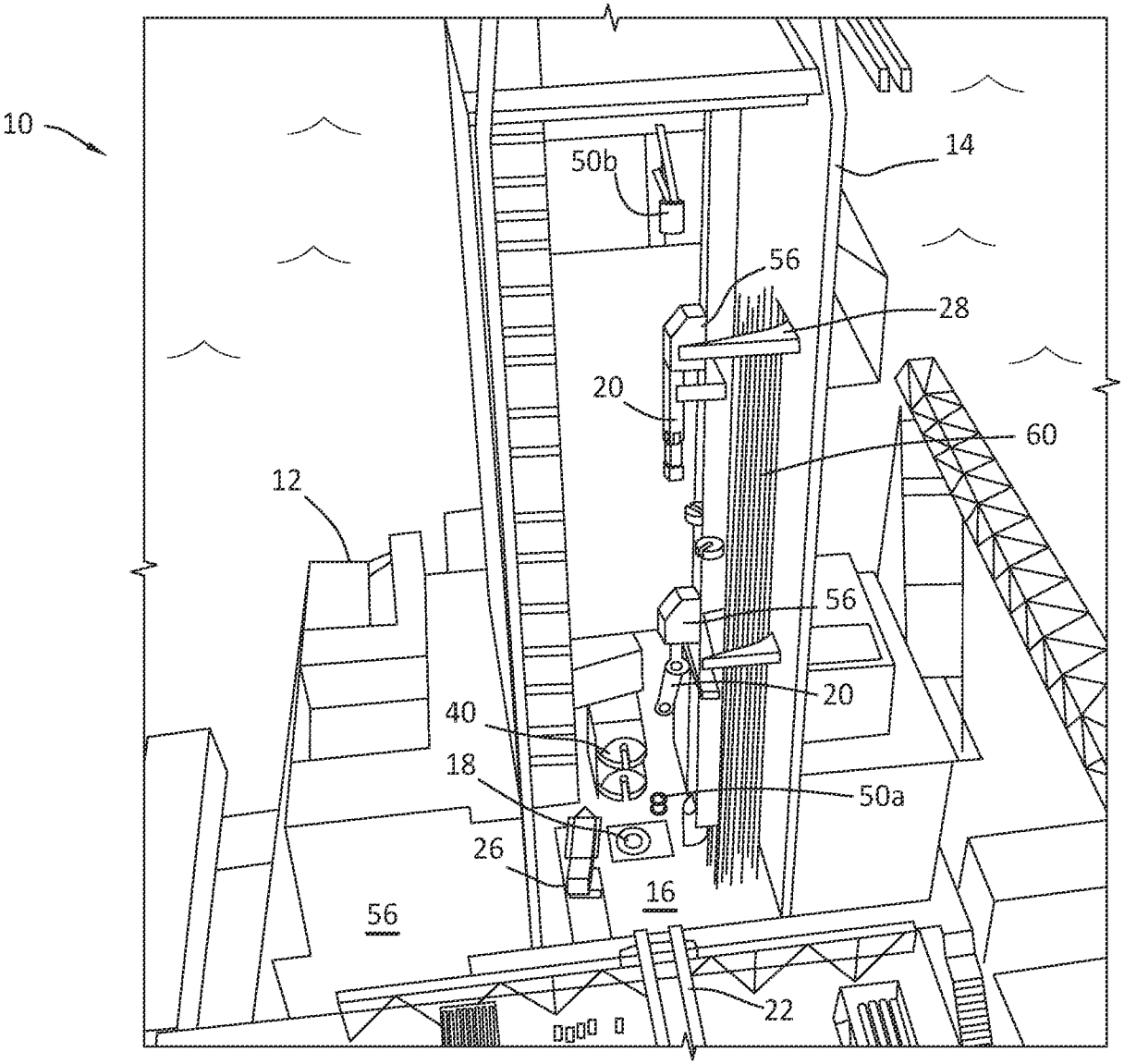
FIG. 1A is a representative perspective view of a rig with upper and lower doping devices, in accordance with certain embodiments.

FIG. 1A is a representative perspective view of a rig 10 with possible locations for upper and lower doping devices 50*b*, 50*a*. As used herein, "rig" refers to all surface structures (e.g., platform, derrick, vertical storage area, horizontal storage area, drill floor, etc.) used during a subterranean operation. The rig 10 is shown as being an offshore rig, but the principles of this disclosure are equally applicable to land-based rigs. The rig 10 can include a platform 12 with a derrick 14 extending from a rig floor 16. The rig 10 can include various equipment used for performing a subterranean operation (e.g., drilling, completion, treating, casing, workover, etc.). The equipment can include a pipe handler 22 that transfers a tubular 60 between a horizontal storage and a pipe handler 20. As used herein, "tubular" refers to an elongated cylindrical tube and can include any of the tubulars manipulated around a rig, such as tubular segments, tubular stands, tubulars, and tubular string. Therefore, in this disclosure, "tubular" is synonymous with "tubular segment," "tubular stand," and "tubular string," as well as "pipe," "pipe segment," "pipe stand," "pipe string," "casing," "casing segment," or "casing string."

The pipe handler 20 can transfer the tubular 60 between the pipe handler 22, a vertical pipe storage 28, a mouse-hole (not shown), upper doping device 50*b*, lower doping device 50*a*, and a well center 18. An iron roughneck 40 can be used to torque the tubular 60 onto or off of a tubular string 66 (see FIG. 1B) positioned in a wellbore, which is below the well center 18 and aligned with the well center 18. A controller 56 can be a rig controller 56 that provides control to some rig operations (such as the pipe handlers and the iron roughneck 40). Alternatively, or in addition to, the controller 56 can be (or include) a controller in the pipe handler 20 that controls that pipe handler 20 and the doping devices 50*a*, 50*b* as well as be (or include) a controller in the iron roughneck 40. Also, the controllers for each of the pipe handler 20 and the iron roughneck can communicate with the rig controller 56 to facilitate subterranean operations on the rig 10.

Figure 1B:
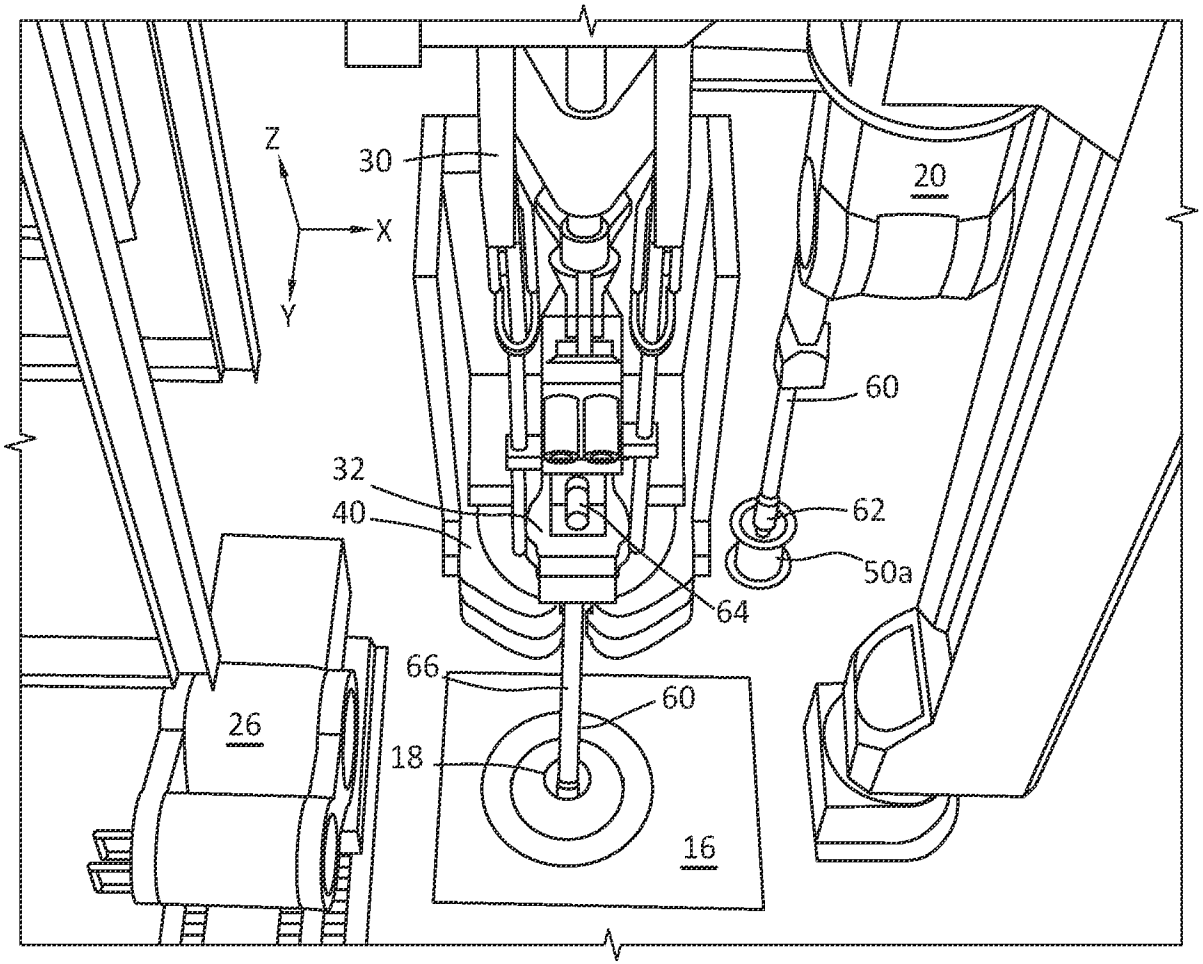
FIGS. 1B and 1C are representative perspective views of a rig with a pipe handler utilizing a doping device to apply dope to threads of a tubular during a subterranean operation prior to aligning the tubular with the stickup at well center and torqueing the joint via the iron roughneck to extend the tubular string, in accordance with certain embodiments.

FIG. 1B is a representative perspective view of a rig 10 with a pipe handler 20 utilizing a doping device 50*a* to clean threads of a pipe segment and apply dope to the threads during a subterranean operation (e.g., drilling, completion, etc.). FIG. 1B shows an example rig floor 16 and rig equipment (e.g., drill floor robot 26, iron roughneck 40, pipe handler 20, elevator 32, top drive 30, etc.) adding a tubular 60 to a tubular string 66 that is extended through the well center 18 of the drill floor 16. The pipe handler 20 can receive a tubular 60 from horizontal storage via the pipe handler 22 or extract a tubular 60 from a vertical storage of the fingerboard 28. Each tubular 60 can have a pin end 62 and a box end 64 with the pin end 62 oriented below the box end 64, in the vertical position. It should be understood that the box end 64 of the tubular 60 can include a collar that is connected to one end of the tubular 60 (e.g., casing pipe). The box end 64 merely refers to an end of the tubular 60 that has internal threads, even if the internal threads are provided by a collar connected to a pipe segment (such as casing).

When tripping the tubular string 66 into the wellbore, the pipe handler 20 can move the next tubular 60 to be connected to the tubular string 66 to the well center for alignment with the tubular string 66. The pipe handler 20, with the tubular 60 in a vertical position, can position the pin end 62 above the well center and lower the tubular 60 vertically into engagement with the box end 64 of the tubular string 66 at the well center 18. However, there may need to be an alignment tool or personnel to align the pin end 62 of the tubular with the box end 64 of the tubular string 66 to then stab the pin end 62 of the tubular into the box end 64 of the tubular string 66. The stabbing guide 100 (FIG. 2) of this disclosure provides a novel approach to aligning the pin end 62 of the tubular with the box end 64 of the tubular string 66 and will be described in more detail below.

Figure 1C:
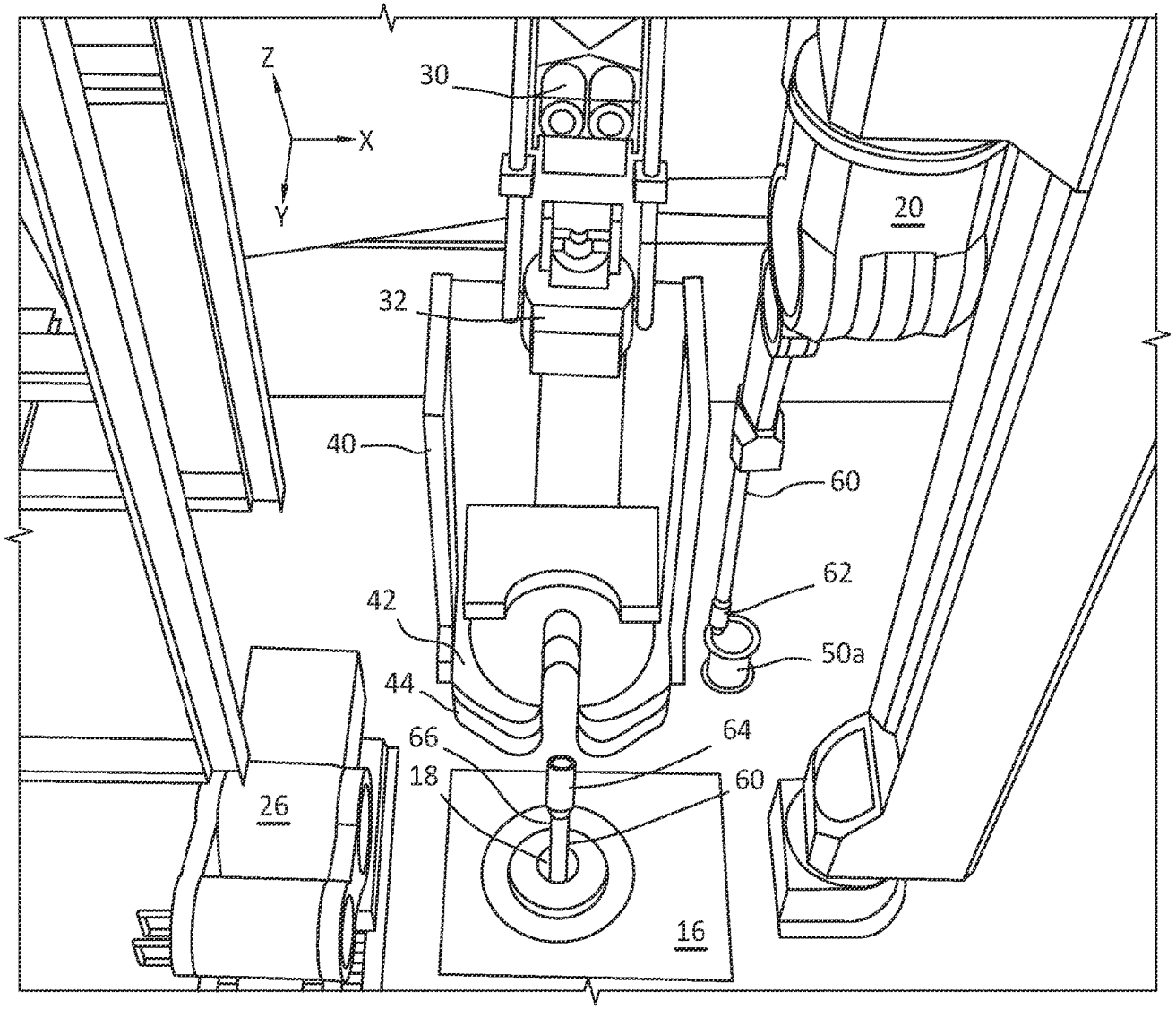

FIG. 1C is another representative perspective view of a rig with a pipe handler 20 utilizing a doping device 50*a* to apply dope to threads of a tubular 60 during a subterranean operation. Comparing this figure to FIG. 1B, the top drive 30, and elevator 32 have moved away from the tubular string 66 after having extended the tubular string 66 further into a wellbore with a remaining stickup of the tubular string 66 protruding from the well center 18. The pipe handler 20 is beginning to transport the tubular 60 to the well center 18 where the tubular 60 can be aligned to the tubular string 66 and connected to the tubular string 66 by the pipe handler 20, the top drive 30, or the iron roughneck 40. The iron roughneck 40 can include a torque wrench 42 and a backup tong 44, where the backup tong grips the stickup at well center 18 and hold sit stationary relative to the rig floor 16, and the torque wrench 42 grips the tubular 60 and rotates the tubular 60 relative to the tubular string 66 to apply the desired torque to the joint to make the joint connection.

Figure 2A:
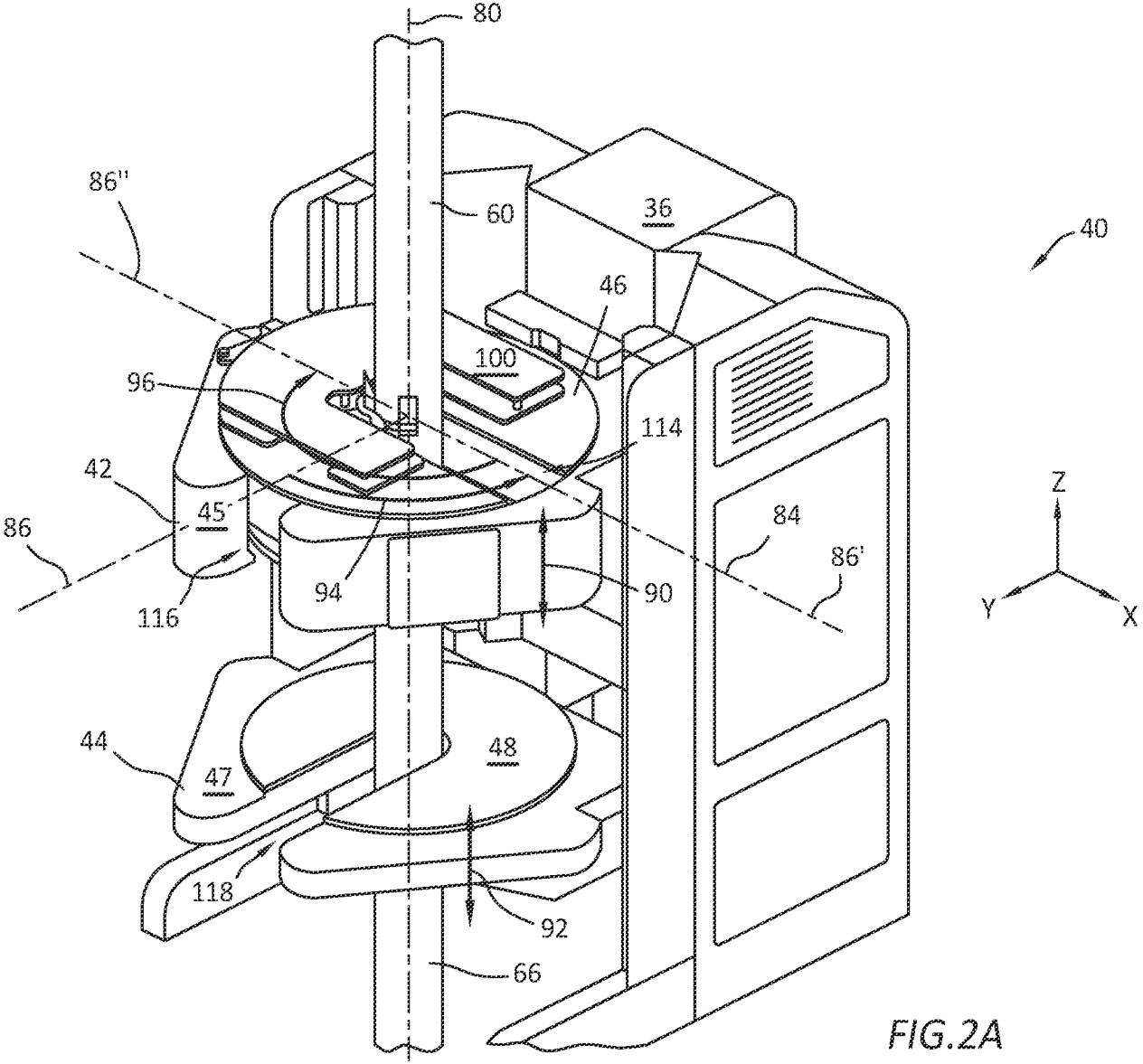
FIG. 2A is a representative perspective view of an iron roughneck with a stabbing guide gripping a tubular string; in accordance with certain embodiments.

FIG. 2A is a representative perspective view of an iron roughneck 40 with a stabbing guide 100 mounted on the torque wrench 42 and gripping a tubular string 66 after a tubular 60 has been aligned with the tubular string 66, via the stabbing guide 100. When the tubular 60 has been aligned with tubular string 66, then the pin end 62 of the tubular 60 can be stabbed into the box end 64 of the tubular string 66 and threaded together by spinning the pin end 62 of the tubular 60 into the box end 64 of the tubular string 66. Once the "spinning in" of the tubular 60 is complete, the iron roughneck 40 can be used to apply a desired torque to the joint to makeup the joint connection.

The iron roughneck 40 can include a body 36 that provides the support structure and equipment to operate the iron roughneck 40. The iron roughneck 40 can include a torque wrench 42 and a backup tong 44, with each slidably coupled to the body. The torque wrench 42 is held in a generally horizontal orientation relative to the rig floor 16 and can move vertically (arrows 90) while maintaining the generally horizontal orientation. Similarly, the backup tong 44 is held in a generally horizontal orientation relative to the rig floor 16 and can move vertically (arrows 92) while maintaining the generally horizontal orientation. This allows both the torque wrench 42 and the backup tong 44 to be vertically adjusted to accommodate engaging and torqueing a joint connection of the tubular string 66.

FIG. 2A shows the iron roughneck 40 with the torque wrench 42 and the backup tong 44 vertically adjusted to accommodate engaging and torqueing a joint connection in a tubular string 66 (e.g., a casing string), where the torque wrench 42 is engaged with a body of the tubular 60 (e.g., casing pipe) above the joint and the backup tong 44 is engaged with a body of the tubular string 66 (e.g., casing string) below the joint. It may not be desirable to clamp either the torque wrench 42 or the backup tong 44 to the box end 64 of the tubular string 66 or the pin end 62 of the tubular 60 when making up a casing string joint.

The torque wrench 42 can include a gripper assembly 46 that rotates within a body 45 about a center axis 80. The center axis 80 can also be seen as a center axis of the stabbing guide 100, where the center axis of the stabbing guide 100 can be at a center of a circle (or oval) formed by the guide elements 110*a-d*. Additionally, the center axis 80 can refer to the center longitudinal axis of the stickup 68. Therefore, the center axis 80, as used herein, refers to either the center axis of the stabbing guide 100 (i.e., center of the circle, or oval, of guide elements), the center axis of the stickup 68, or the center axis of the torque wrench 42 (i.e., center of rotation of the torque wrench 42), or combinations thereof when these three elements are aligned. The body 45 is rotationally coupled to the gripper assembly 46 and the body 45 is slidably coupled to the body 36 of the iron roughneck 40. The backup tong 44 can include a gripper assembly 48 that rotates within a body 47 about the center axis 80. The body 47 is rotationally fixed to the gripper assembly 48 and the body 47 is slidably coupled to the body 36 of the iron roughneck 40.

When the torque wrench 42 is in a default position, such as when the iron roughneck 40 is away from well center 18, a horizontal opening 116 through a side of the torque wrench 42 can be in alignment with a horizontal opening 114 having a horizontal center axis 84. In the default position, the horizontal center axis 84 can be positioned at an azimuthal position 86 relative to the vertical center axis 80. With the opening 114 at azimuthal position 86, a tubular 60 can enter the torque wrench radially through the opening 116 and opening 114 toward the center axis 80. It should be understood that it is not required that the tubular 60 enter the torque wrench 42 via the openings 114, 116. The tubular 60 can be lowered into the opening 114 from a position vertically above the torque wrench 42.

With the tubular 60 positioned in the opening 114 proximate the center axis 80 (or above the opening 114 proximate the center axis 80) and above the tubular string 66, the torque wrench 42 can be rotated (arrows 94) to position the center axis 84 at an azimuthal position 86'. With the gripper assembly 46 of the torque wrench 42 rotated to azimuthal position 86', the stabbing guide can be activated to move its guide elements radially inward toward the center axis 80 to align the tubular 60 in the opening 114 with the center axis 80 (and thus the tubular string 66), or the guide elements can be positioned radially inward toward the center axis 80 to prepare for aligning the tubular 60 with the center axis 80 (and thus the tubular string 66).

After the tubular 60 is aligned with the center axis 80, then the pin end 62 of the tubular 60 can be lowered into engagement with the box end 64 of the tubular string 66 and spun into the box end 64 to form a joint in the tubular string 66. To apply a desired torque to the joint, the backup tong 44 can rotationally fix the tubular string 66 to the body 36 of the iron roughneck 40, and rotate the tubular 60 relative to the body 36 by rotating the gripper assembly 46 (arrows 96) from the azimuthal position 86' to the azimuthal position 86". Once the desired torque is applied to the joint to makeup the joint connection, the gripper assembly 46 can rotate back to the azimuthal position 86 and allow the iron roughneck 40 to return to a position away from the well center.

Figure 2B:
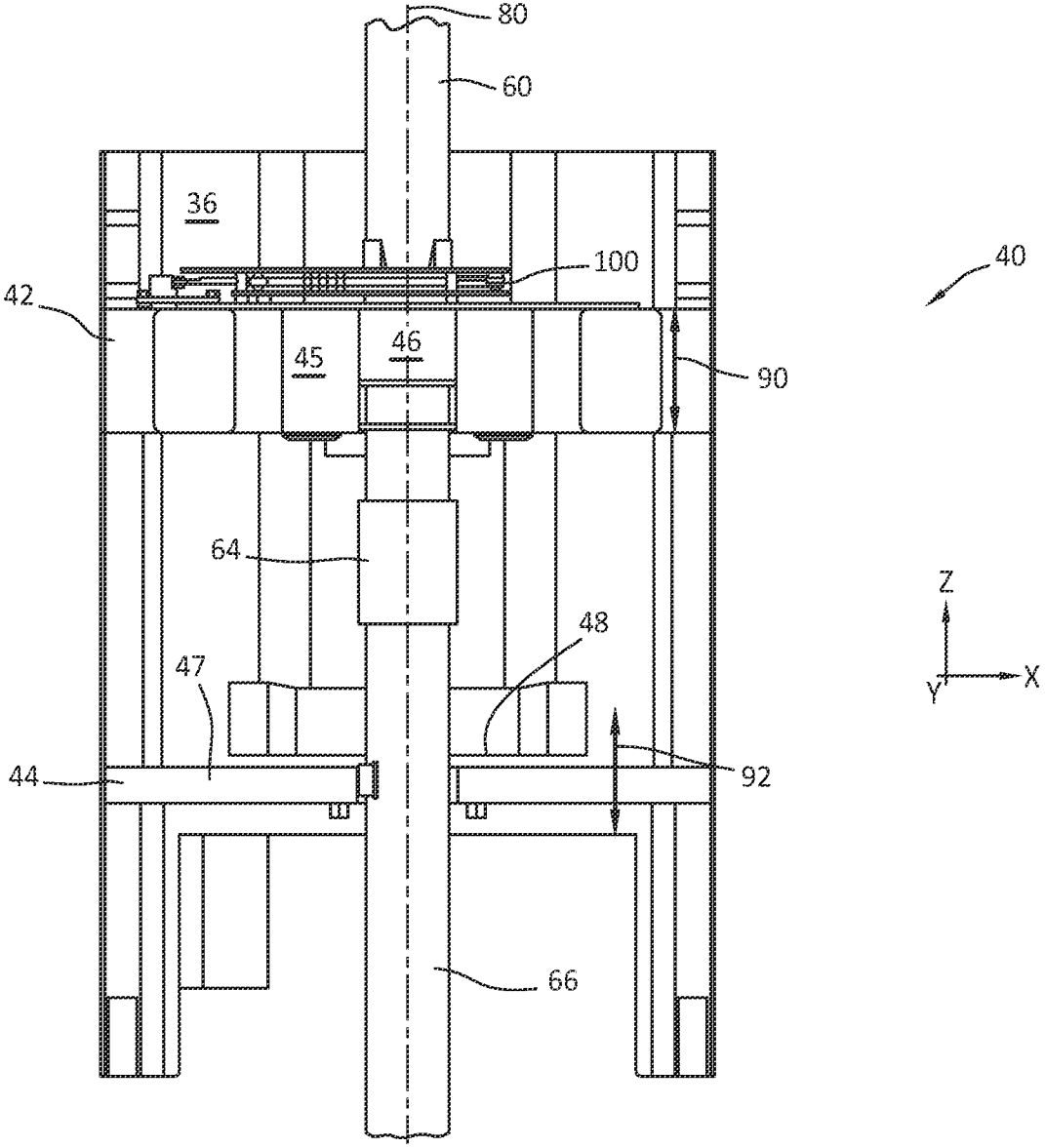
FIG. 2B is a representative front view of an iron roughneck with a stabbing guide gripping a tubular string, in accordance with certain embodiments.

FIG. 2B is a representative front view of an iron roughneck 40 with a stabbing guide 100 mounted on the torque wrench 42 and gripping a tubular string 66 after a tubular 60 has been aligned with the tubular string 66, via the stabbing guide 100. FIG. 2B shows how the torque wrench 42 and the backup tong 44 can be vertically positioned to engage the tubular string 66 above (torque wrench 42) and below (backup tong 44) the joint at box end 64.

Figure 3:
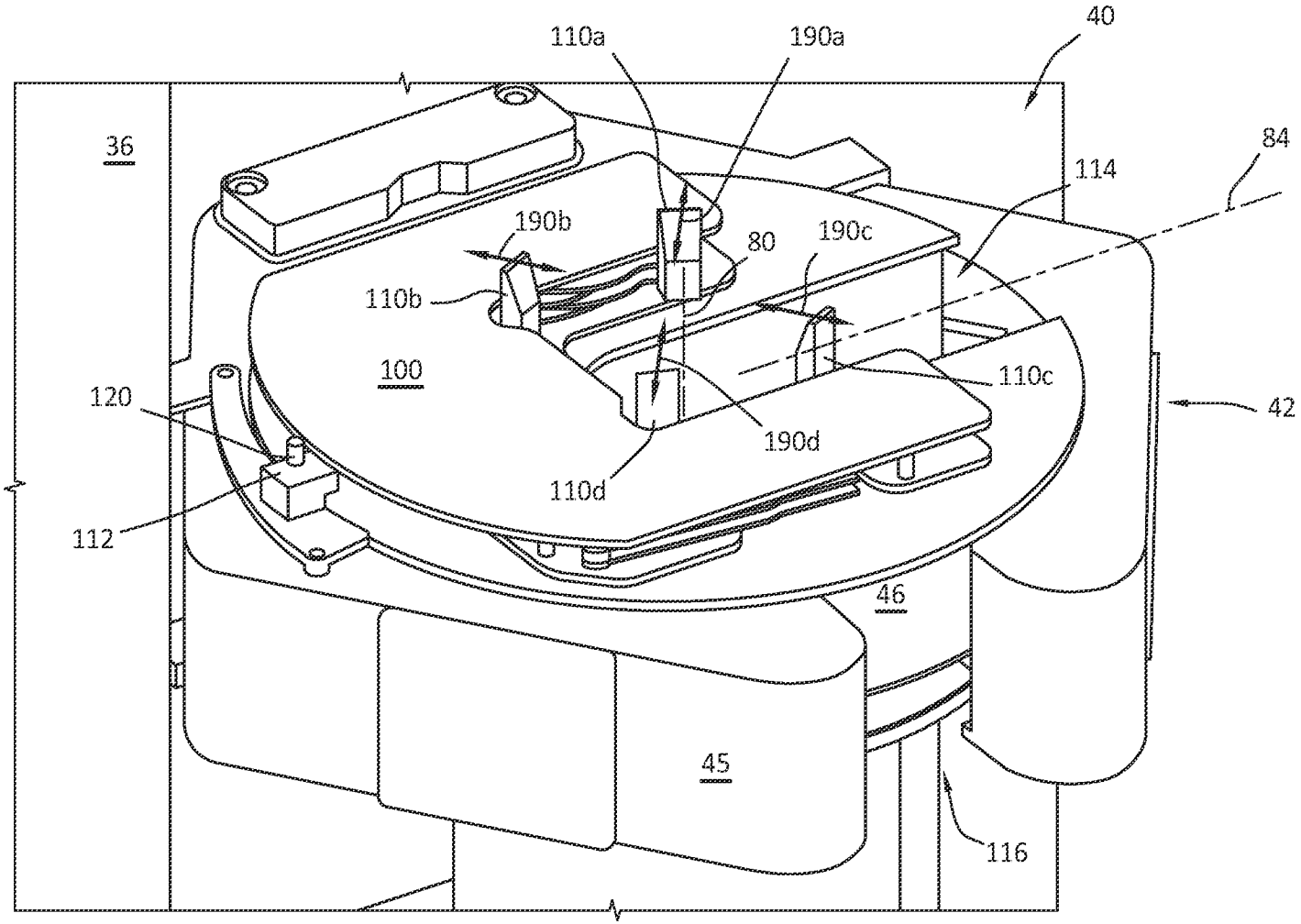
FIG. 3 is a representative perspective view of a torque wrench of an iron roughneck having a stabbing guide mounted thereon, in accordance with certain embodiments.

FIG. 3 is a representative perspective view of a torque wrench 42 of an iron roughneck 40 having a stabbing guide 100 mounted thereon. The stabbing guide 100 can include an element 120 for engaging a stop 112 when the gripper assembly 46 is rotated counterclockwise relative to the body 45 as seen in the perspective shown in FIG. 3. As the element 120 engages the stop 112 and the gripper assembly 46 rotates further counterclockwise, the guide elements 110*a-d* can move radially toward a center axis 80 (respective arrows 190*a-d*) a substantially equal distance. It is preferred that the guide elements 110*a-d* generally form a circle surrounding the center axis 80, with a diameter of the circle varying depending upon the rotation of the gripper assembly 46 relative to the body 45. As the guide elements 110*a-d* move radially inward, the diameter of the circle decreases, and as the guide elements 110*a-d* move radially outward, the diameter of the circle increases.

Therefore, the stabbing guide 100, via movement of the guide elements 110*a-d*, can accommodate tubulars 60 of various diameters. As the element 120 engages the stop 112 and the gripper assembly 46 rotates clockwise, the guide elements 110*a-d* can move radially away from the center axis 80 (respective arrows 190*a-d*) a substantially equal distance. It should be understood that the guide elements 110*a-d* may not move together at exactly the same time or for exactly the same distance, for example, due to mechanical tolerances of the linkage assembly 103. Therefore, the circle formed by the guide elements 110*a-d* can be a circle with a varying radius around the circumference of the circle, such as with an oval shape. Additionally, the center of the circle, or oval, can be substantially aligned with the center axis 80 of the stickup 68, but it may not necessarily be exactly aligned with the center axis 80 of the stickup 68. Therefore, when referring to a "circle" of the guide elements 110*a-d*, this includes a circle with a constant radius around the circumference of the circle, as well as an oval with a varied radius around the circumference of the oval.

Figure 4A:
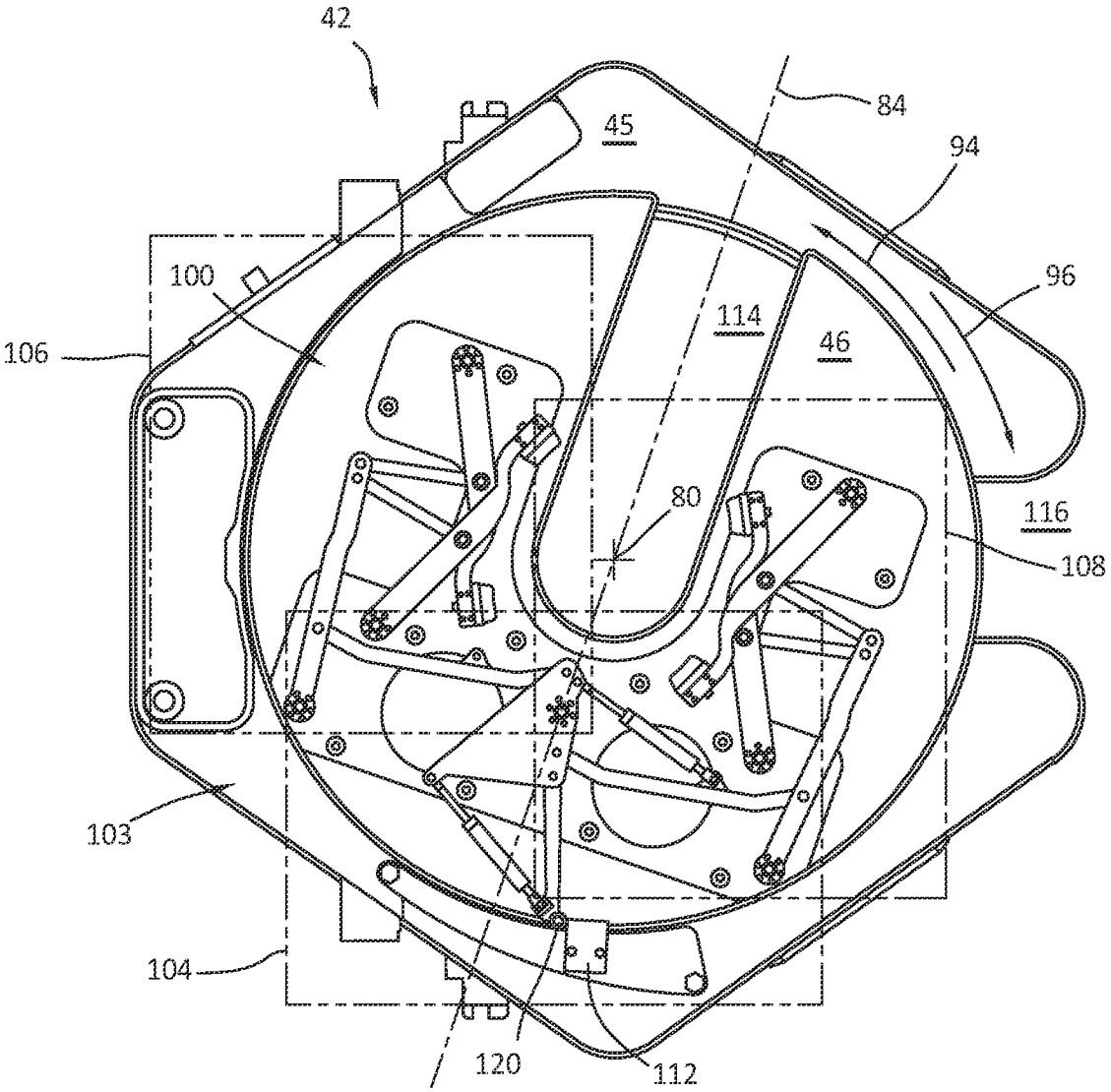
FIG. 4A is a representative top view of a torque wrench of an iron roughneck having a stabbing guide mounted thereon with linkage sub-assemblies identified, in accordance with certain embodiments.

Referring now to FIGS. 4A-4D, the operation of the stabbing guide 100 will be described. FIG. 4A is a representative top view of a torque wrench 42 of an iron roughneck 40 having the stabbing guide 100 mounted thereon with a linkage assembly 103 that can include linkage sub-assemblies 104, 106, 108. The torque wrench 42 can include a gripper assembly 46 that can rotate relative to the body 45 of the torque wrench 42. As used herein, counterclockwise rotation and clockwise rotation refer to a perspective shown in FIG. 4A, with arrows 94 indicating the counterclockwise rotation of the gripper assembly 46 relative to the body 45 and arrow 96 indicating the clockwise rotation of the gripper assembly 46 relative to the body 45.

The sub-assemblies 104, 106, 108 are coupled together and operate as one linkage assembly 103. However, the following discussion will describe the sub-assemblies 104, 106, 108 individually for discussion purposes and indicate the coupling connections between them. The sub-assembly 104 can be referred to as the drive sub-assembly 104 since it includes the engaging element 120 and the stop 112. The sub-assembly 106 includes the left two guide elements 110*a*, 110*b* and includes links that operate these guide elements. The sub-assembly 108 includes the right two guide elements 110*c*, 110*d* and includes links that operate these guide elements. Left and right designations merely provide distinguishing terms to describe the sub-assemblies 104, 106, 108, with left and right being relative to the view in the figures. The drive sub-assembly 104 operates to drive the left and right sub-assemblies 106, 108 to move the guide elements 110*a-d* radially toward or away from the center axis 80.

Figure 4B:
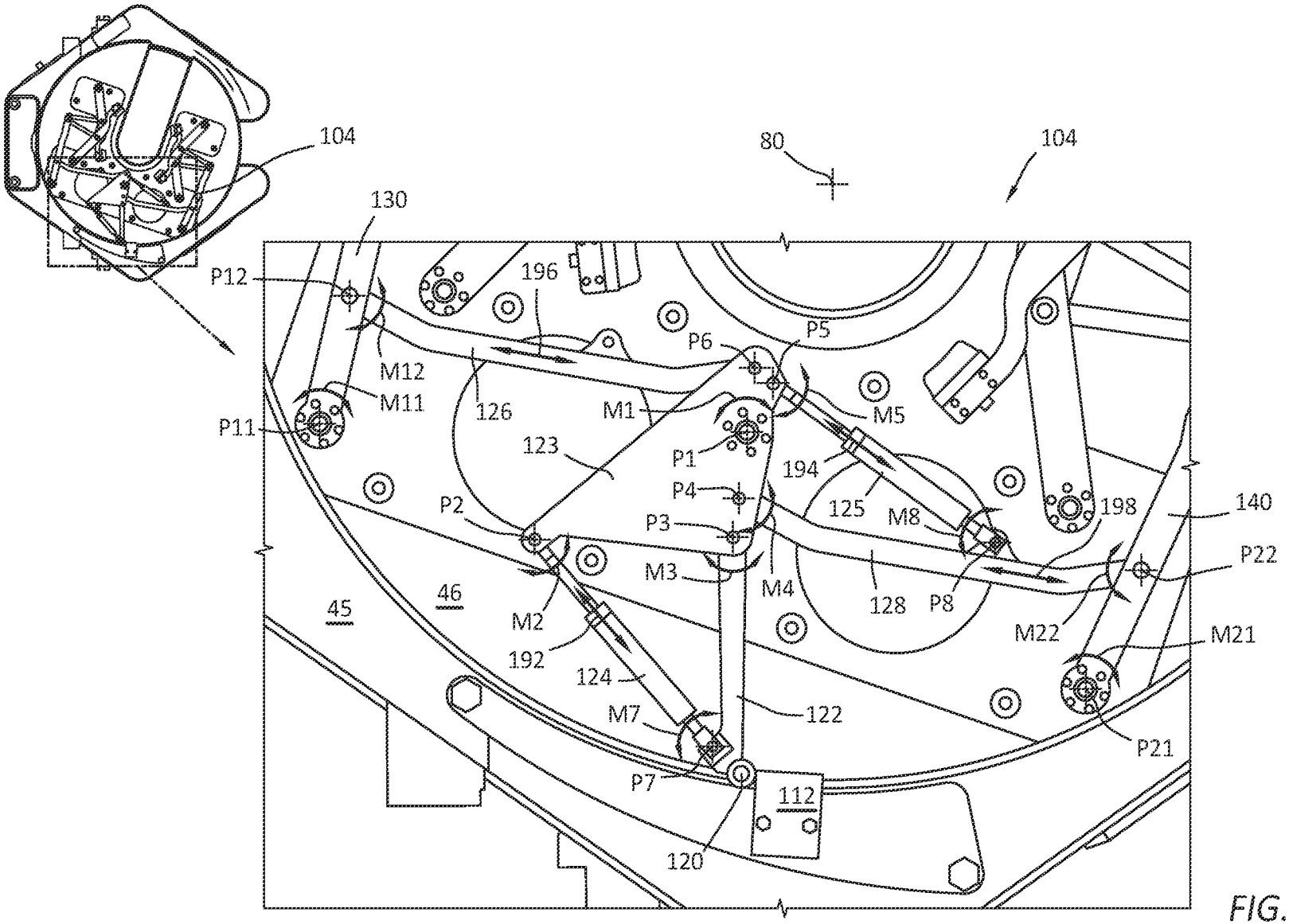
FIGS. 4B-D are representative top views of the linkage sub-assemblies of the stabbing guide mounted on the torque wrench of an iron roughneck, in accordance with certain embodiments.

Referring to FIG. 4B to describe the drive sub-assembly 104, when the engaging element 120 engages the stop 112 as the gripper assembly 46 is rotated counterclockwise 94 relative to the body 45, the engagement element 120 remains engaged with the stop 112, and act on the biasing device 124 (e.g., gas piston) to drive the drive plate 123 at the pivot P2, which can cause the drive plate 123 to rotate about the pivot P1 (arrows M1). The drive plate 123 can be rotationally coupled to the body 45 via the pivot P1. As the drive plate 123 rotates, the biasing device 124 can rotate about the pivot P2 (arrows M2) and about pivot P7 (arrows M7) that couples the biasing device 124 to the link 122. If the guide elements 110*a-d* are not engaged with a tubular 60, then the biasing device 124 can remain extended to its at rest length. However, if the guide elements 110*a-d* do engage a tubular 60, then the biasing device 124 can retract (arrows 192) to accommodate the inability of the guide elements 110*a-d* to move further radially inward while allowing the gripper assembly 46 to rotate further in the counterclockwise direction.

The biasing device 124 can also allow the guide elements 110*a-d* to be forced radially away from the center axis 80 by a tubular 60 while the gripper assembly 46 remains stationary relative to the body 45 after setting the circle (or oval) of the guide elements 110*a-d* to a desired diameter. For example, if the guide elements 110*a-d* are set to a diameter that is less than an outer diameter of the tubular 60, the guide elements 110*a-d* can be forced radially away from the center axis 80 to allow the tubular 60 to be vertically inserted into the stabbing guide 100. This is also why the guide elements 110*a-d* can be formed with an inclined surface that faces the center axis 80 to allow tubular 60 to engage the guide elements 110*a-d* and travel along the inclined surfaces of the guide elements 110*a-d* to force the guide elements 110*a-d* to a greater diameter and guide the tubular into the center of the guide elements 110*a-d*.

When the engaging element 120 engages the stop 112 as the gripper assembly 46 is rotated counterclockwise 94, the engaging element 120 can cause the link 122 to rotate about the pivot P3 (arrows M3) relative to the drive plate 123. While the drive plate 123 rotates (arrows M1) about pivot P1, the link 128 can be rotated about the pivot P4 (arrows M4) that couples the link 128 to the drive plate 123. Another biasing device 125 can be coupled between the drive plate 123 at the pivot P5 and the link 128 at pivot P8. When the drive plate 123 rotates (arrows M1) about pivot P1 and the link 128 is rotated about the pivot P4 (arrows M4), the biasing device 125 can be compressed (arrows 194) to store energy as the link 128 is rotated toward the drive plate 123, with the biasing device 125 rotatable about pivot P5 (arrows M5) of the link 128 relative to the drive plate 123 and rotatable about pivot P8 (arrows M8) of the biasing device 125 relative to the link 128.

When the engaging element 120 engages the stop 112 as the gripper assembly 46 is rotated counterclockwise 94 relative to the body 45, rotation of the drive plate 123 about the pivot P1 can cause the link 128 to move laterally (arrows 198, via the pivot P4 coupling), which can cause the link 140 to rotate about the pivot P21 (arrows M21) via the pivot P22 coupling between the link 128 and the link 140, which allows the link 128 to rotate about the pivot P22 (arrows M22).

When the engaging element 120 engages the stop 112 as the gripper assembly 46 is rotated counterclockwise 94 relative to the body 45, rotation of the drive plate 123 about the pivot P1 can cause the link 126 to move laterally (arrows 196, via the pivot P6 coupling), which can cause the link 130 to rotate about the pivot P11 (arrows M11) via the pivot P12 coupling between the link 126 and the link 130, which allows the link 126 to rotate about the pivot P12 (arrows M12).

Figure 4C:
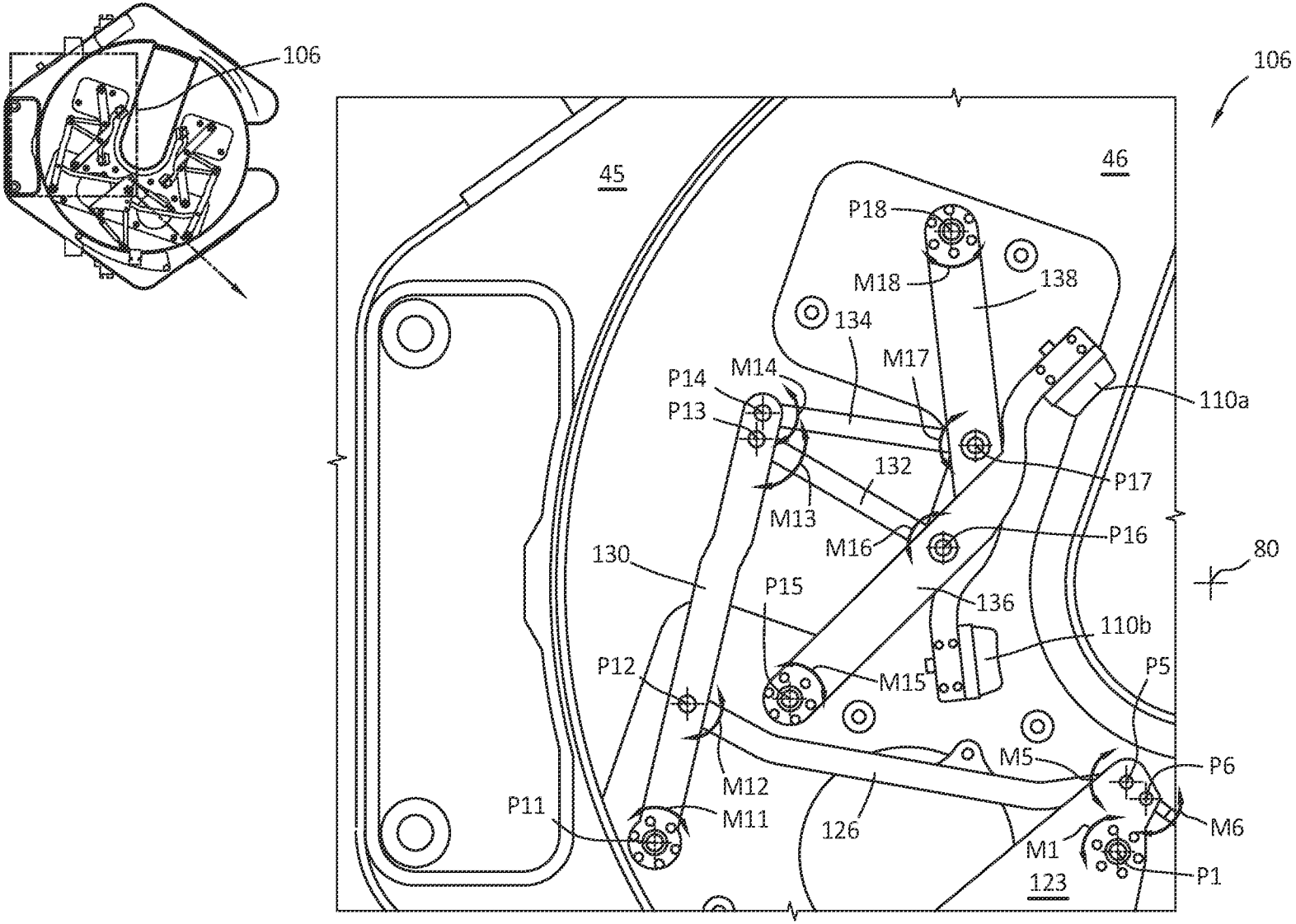

Referring to FIG. 4C to describe the drive sub-assembly 106, when the engaging element 120 engages the stop 112 as the gripper assembly 46 is rotated counterclockwise 94 relative to the body 45, rotation of the drive plate 123 about pivot P1 can cause the link 126 to move laterally, as mentioned above. Lateral movement (arrows 196) of the link 126 can cause the link 130 to rotate about pivot P11 (arrows M11). The pivot P11 can rotationally couple the link 130 to the gripper assembly 46. Clockwise rotation of the drive plate 123 can cause clockwise rotation of the link 130 about the pivot P11, which can move the pivots P13, P14 toward the center axis 80. The link 132 can be rotationally coupled to the link 130 via the pivot P13 and the link 134 can be rotationally coupled to the link 130 via the pivot P14. As the link 130 is rotated clockwise about pivot P11, the links 132, 134 can drive respective links 136, 138 toward the center axis 80.

The link 132 can rotate about pivot P13 (arrows M13) relative to the link 130 and rotate about the pivot P16 (arrows M16) as needed to drive the link 136 and rotate the link 136 about the pivot P15 (arrows M15), which can be rotationally coupled to the gripper assembly 46. The link 134 can rotate about pivot P14 (arrows M14) relative to the link 130 and rotate about the pivot P17 (arrows M17) as needed to drive the link 138 and rotate the link 138 about the pivot P18 (arrows M18), which can be rotationally coupled to the gripper assembly 46. As the link 130 is rotated clockwise, the link 132 drives the link 136 in a clockwise rotation about the pivot P15 and moves the guide element 110*a* radially inward toward the center axis 80. As the link 130 is rotated clockwise, the link 134 drives the link 138 in a clockwise rotation about the pivot P18 and moves the guide element 110*b* radially inward toward the center axis 80.

Figure 4D:
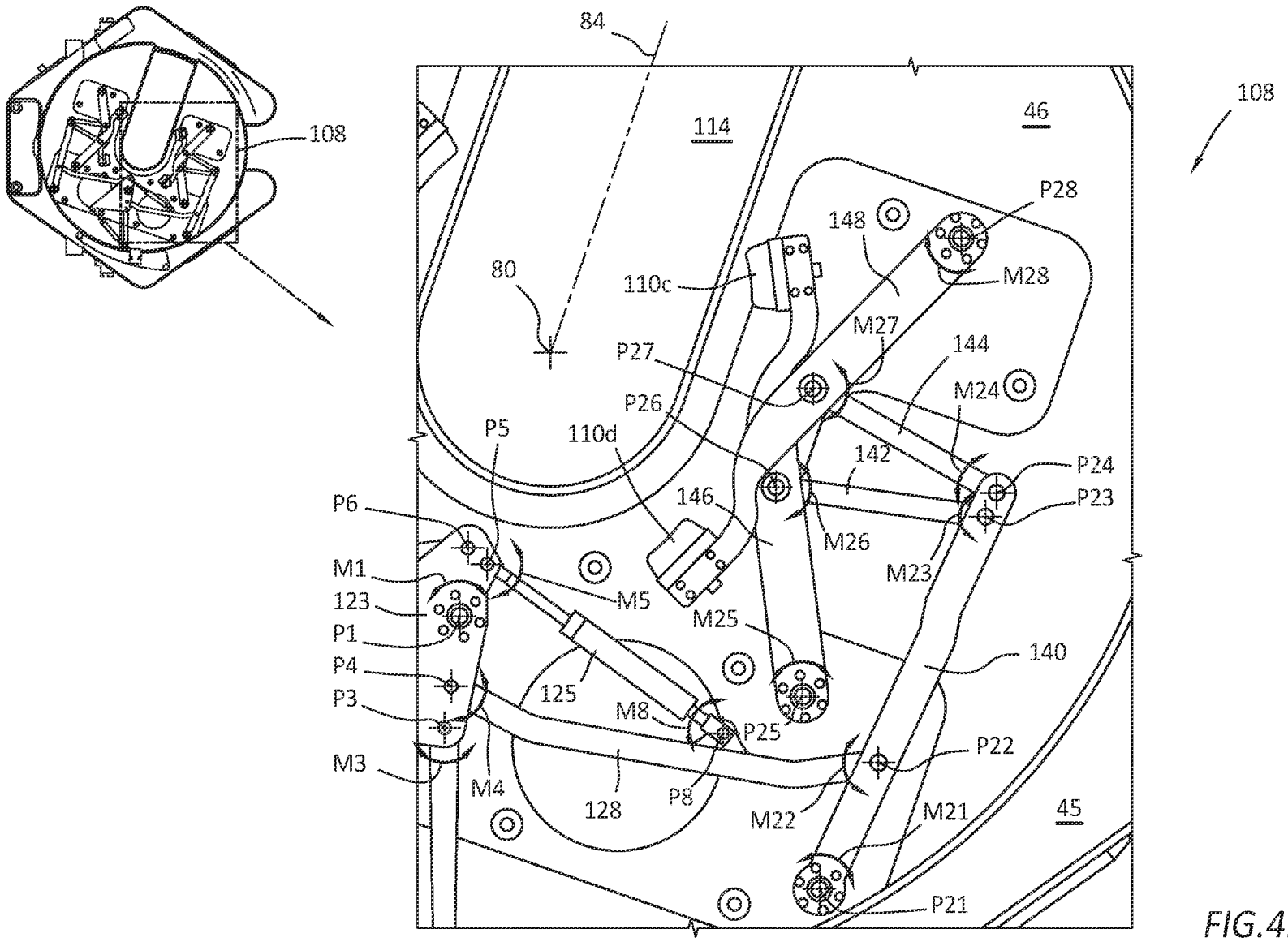

Referring to FIG. 4D to describe the drive sub-assembly 108, when the engaging element 120 engages the stop 112 as the gripper assembly 46 is rotated counterclockwise 94 relative to the body 45, rotation of the drive plate 123 about pivot P1 can cause the link 128 to move laterally, as mentioned above. Lateral movement (arrows 198) of the link 128 can cause the link 140 to rotate about pivot P21 (arrows M21). The pivot P21 can rotationally couple the link 140 to the gripper assembly 46. Clockwise rotation of the drive plate 123 can cause counterclockwise rotation of the link 140 about the pivot P21, which can move the pivots P23, P24 toward the center axis 80. The link 142 can be rotationally coupled to the link 140 via the pivot P23 and the link 144 can be rotationally coupled to the link 140 via the pivot P24. As the link 140 is rotated counterclockwise about pivot P21, the links 142, 144 can drive respective links 146, 148 toward the center axis 80.

The link 142 can rotate about pivot P23 (arrows M23) relative to the link 140 and rotate about the pivot P26 (arrows M26) as needed to drive the link 146 and rotate the link 146 about the pivot P25 (arrows M25), which can be rotationally coupled to the gripper assembly 46. The link 144 can rotate about pivot P24 (arrows M24) relative to the link 140 and rotate about the pivot P27 (arrows M27) as needed to drive the link 148 and rotate the link 148 about the pivot P28 (arrows M28), which can be rotationally coupled to the gripper assembly 46. As the link 140 is rotated counterclockwise, the link 142 drives the link 146 in a counterclockwise rotation about the pivot P25 and moves the guide element 110*c* radially inward toward the center axis 80. As the link 140 is rotated counterclockwise, the link 144 drives the link 148 in a counterclockwise rotation about the pivot P28 and moves the guide element 110*d* radially inward toward the center axis 80.

Therefore, via the linkage sub-assemblies 104, 106, 108 of the linkage assembly 103, clockwise rotation of the drive plate 123 can radially extend the guide elements 110*a-d* radially inward toward the center axis 80, and counterclockwise rotation of the drive plate 123 can radially retract the guide elements 110*a-d* radially outward from the center axis 80. The amount of clockwise rotation of the drive plate 123 is generally determined by the amount of counterclockwise rotation of the gripper assembly 46 by the torque wrench 42 past engagement of the engaging element 120 with the stop 112. The larger the counterclockwise rotation of the gripper assembly 46 past engagement of the engaging element 120 with the stop 112, the smaller the diameter of the circle (or oval) of guide elements 110*a-d* becomes. Clockwise rotation of the gripper assembly 46 while the engaging element 120 is engaged with the stop 112 can cause the diameter of the circle of the guide elements 110*a-d* to increase to their at-rest positions when the engaging element 120 disengages from the stop 112. The energy stored in the biasing device 125 when the drive plate 123 is rotated in a clockwise direction can cause the drive plate 123 to rotate in a counterclockwise direction when the gripper assembly 46 rotates in a clockwise direction relative to the body 45.

Figure 5A:
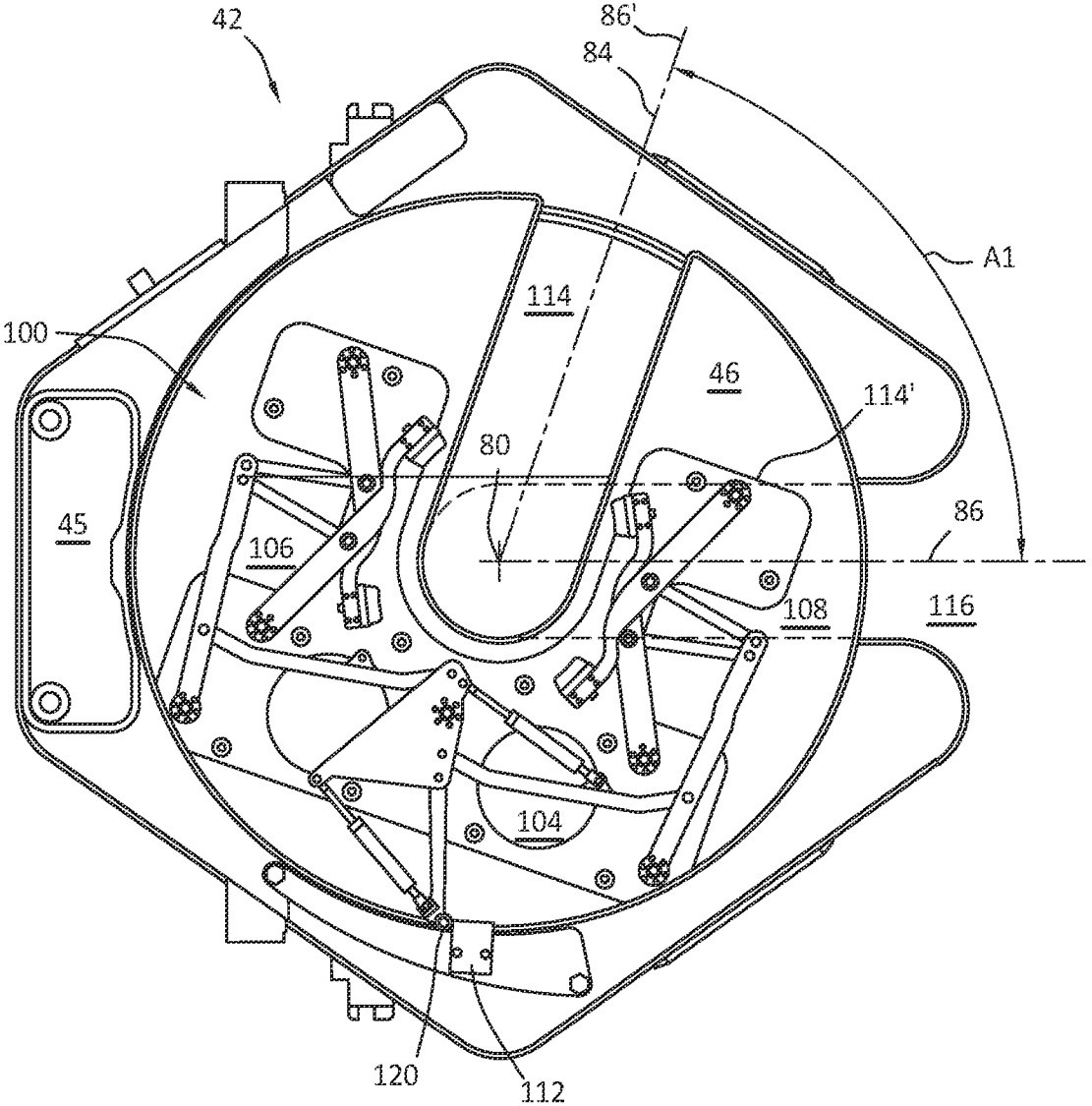
FIGS. 5A-5C are representative top views of the stabbing guide mounted on the torque wrench and rotated to various arc distances to operate the stabbing guide, in accordance with certain embodiments.
Figure 5B:
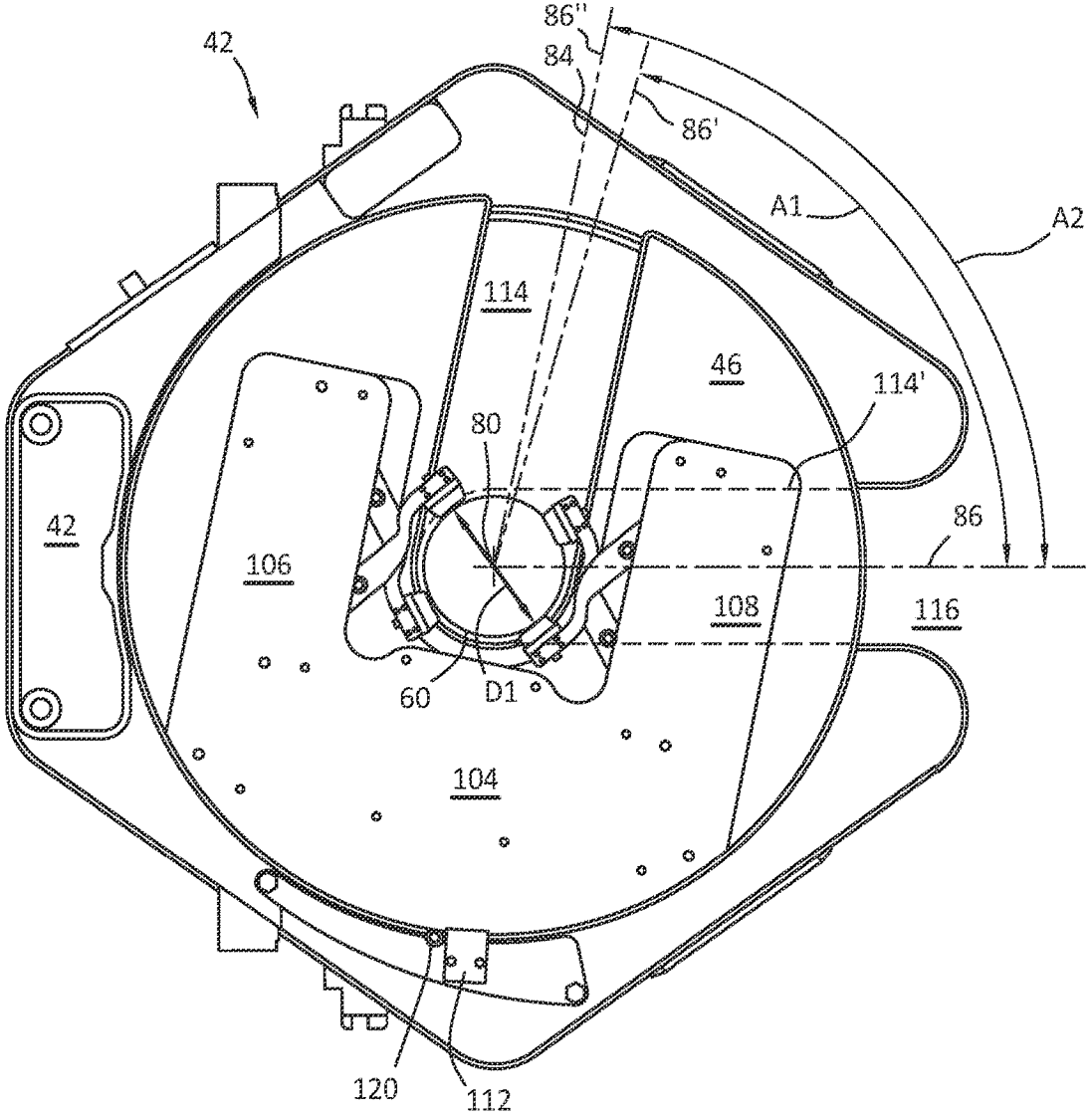
Figure 5C:
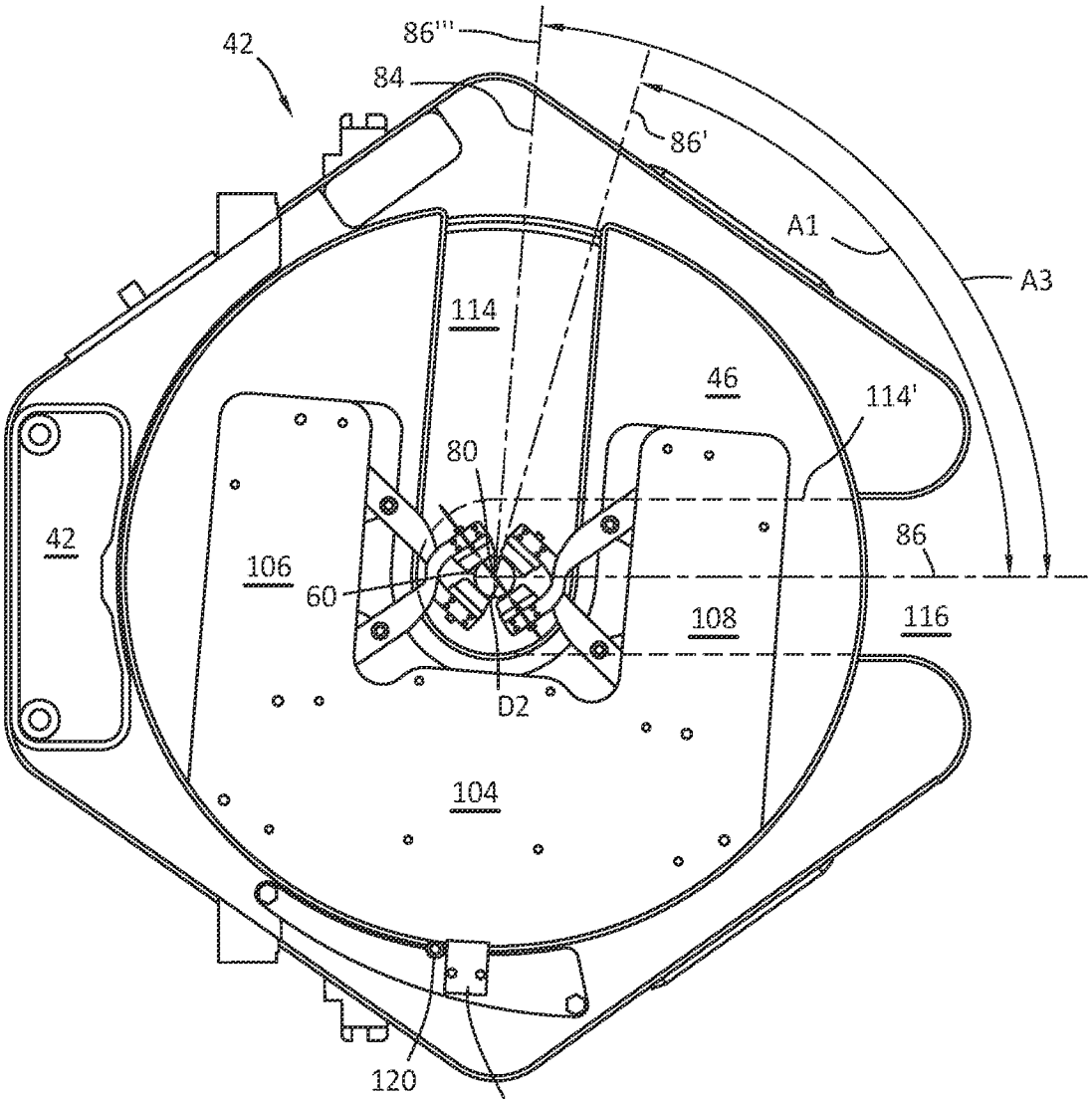

FIGS. 5A-5C are representative top views of the stabbing guide 100 mounted on the torque wrench 42 and rotated to various arc distances to operate the stabbing guide 100. As described above, engaging the engaging element 120 with the stop 112 and rotating the gripper assembly 46 counterclockwise past the point of engagement of the engaging element 120 with the stop 112 can cause the guide elements 110*a-d* to move radially inward toward the center axis 80.

FIG. 5A shows the gripper assembly 46 having an opening 114 that can have a center axis 84 that is initially aligned with a center of the opening 116 in the side of the body 45 at an initial azimuthal position 86. When the gripper assembly 46 is rotated an arc distance A1 thereby moving the center axis 84 to the azimuthal position 86', then the engaging element 120 can begin to engage the stop 112 thereby beginning activation of the stabbing guide 100. The arc distance A1 can be approximately 71 degrees. However, the arc distance A1 can be smaller are larger depending upon the final dimensions of the linkage assembly 103 or the position of the stop 112 around the circumference of the gripper assembly 46, which can be altered to begin activation of the stabbing guide 100 at an arc distance A1 that is less than or greater than 71 degrees. However, the arc distance A1 should be designed so that the gripper assembly 46 has enough clockwise rotation to apply the desired torque to the joint to makeup the joint connection after the stabbing guide 100 can be deactivated (or disengaged from the tubular 60. The stop 112 can also be used to calibrate the stabbing guide 100 to activate at the desired arc distance A1.

FIG. 5B shows the gripper assembly 46 having an opening 114 that can have a center axis 84 that is initially aligned with a center of the opening 116 in the side of the body 45 at an initial azimuthal position 86. The gripper assembly 46 can be rotated an arc distance A2 thereby moving the center axis 84 to the azimuthal position 86" (which is past the azimuthal position 86' at which the engaging element 120 begins to engage the stop 112). Therefore, by rotating the gripper assembly 46 past the azimuthal position 86', the guide elements 110*a-d* can be radially moved inward to form a circle that can accommodate a tubular 60 of outer diameter D1. The arc distance A2 can be approximately 78 degrees, or greater than or less than 78 degrees. The diameter D1 of the tubular can be up to 20 inches (50.8 cm). However, in the current example, with the arc distance approximately equal to 78 degrees, the diameter D1 can be approximately 14 inches (35.56 cm).

FIG. 5C shows the gripper assembly 46 having an opening 114 that can have a center axis 84 that is initially aligned with a center of the opening 116 in the side of the body 45 at an initial azimuthal position 86. The gripper assembly 46 can be rotated an arc distance A3 thereby moving the center axis 84 to the azimuthal position 86''' (which is past the azimuthal position 86' at which the engaging element 120 begins to engage the stop 112). Therefore, by rotating the gripper assembly 46 past the azimuthal position 86', the guide elements 110*a-d* can be radially moved inward to form a circle that can accommodate a tubular 60 of outer diameter D2, which is less than the diameter D1. The arc distance A3 can be approximately 85 degrees, or greater than or less than 85 degrees. The diameter D2 of the tubular can be up to 20 inches (50.8 cm). However, in the current example, with the arc distance approximately equal to 85 degrees, the diameter D2 can be approximately 4 inches (10.16 cm).

The stabbing guide 100 shown in FIGS. 5B, 5C can return the guide elements 110*a-d* back to their at-rest positions (shown in FIG. 5A) by rotating the gripper assembly 46 clockwise so that the center axis 84 rotates past the azimuthal position 86'.

Figure 6A:
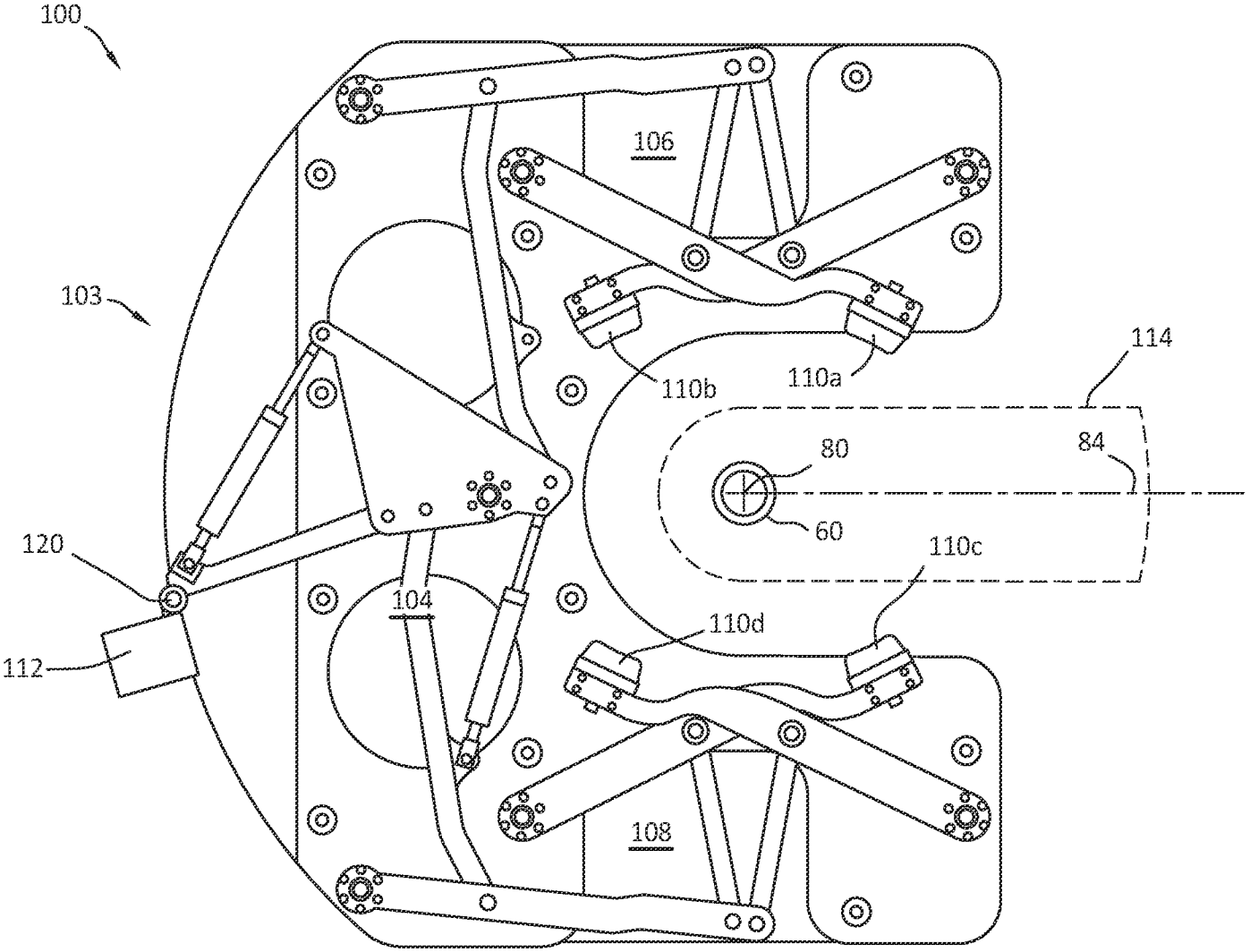
FIGS. 6A-6C are representative top views of the stabbing guide mounted on the torque wrench and rotated to various arc distances to operate the stabbing guide, in accordance with certain embodiments.
Figure 6B:
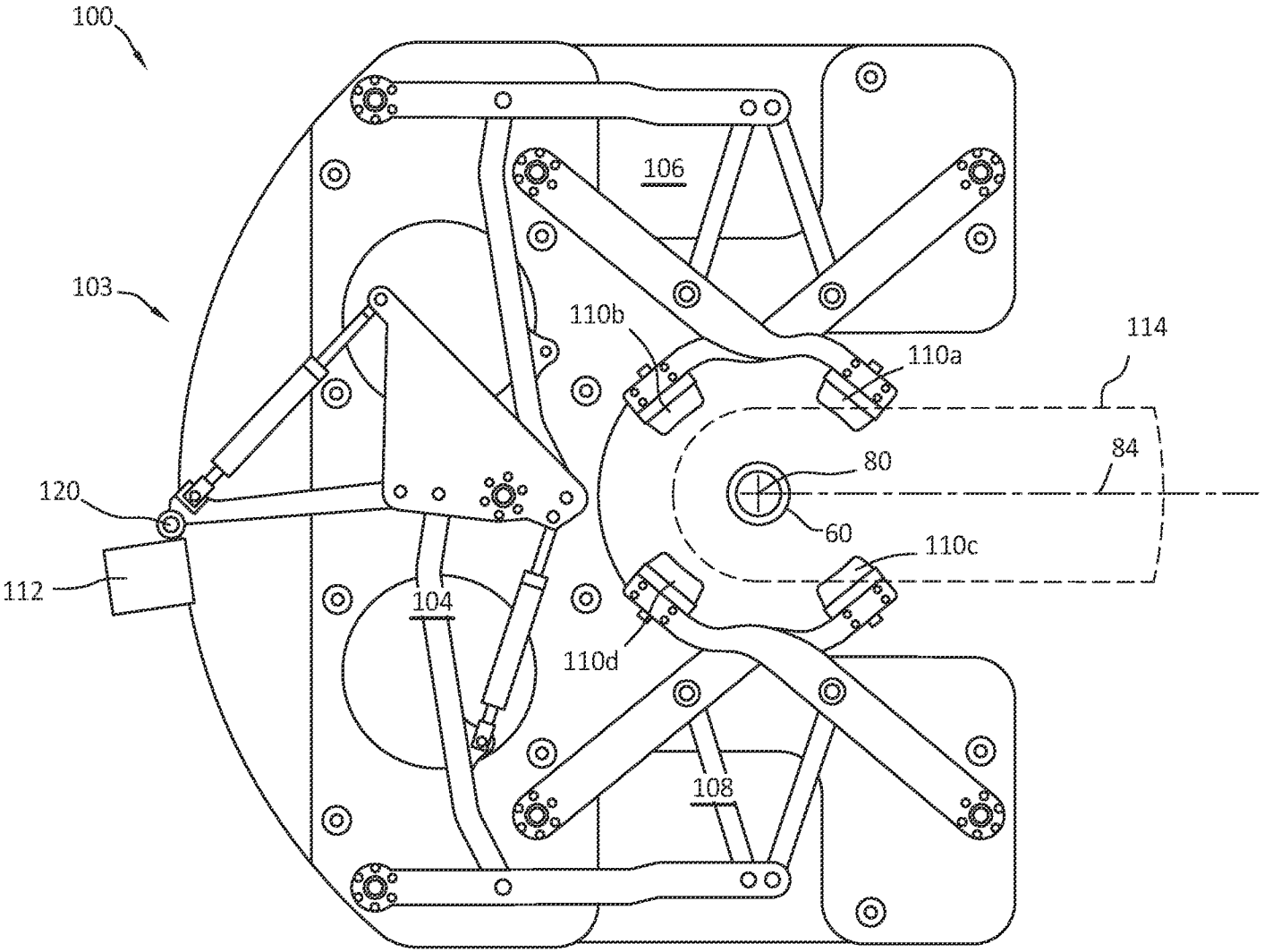
Figure 6C:
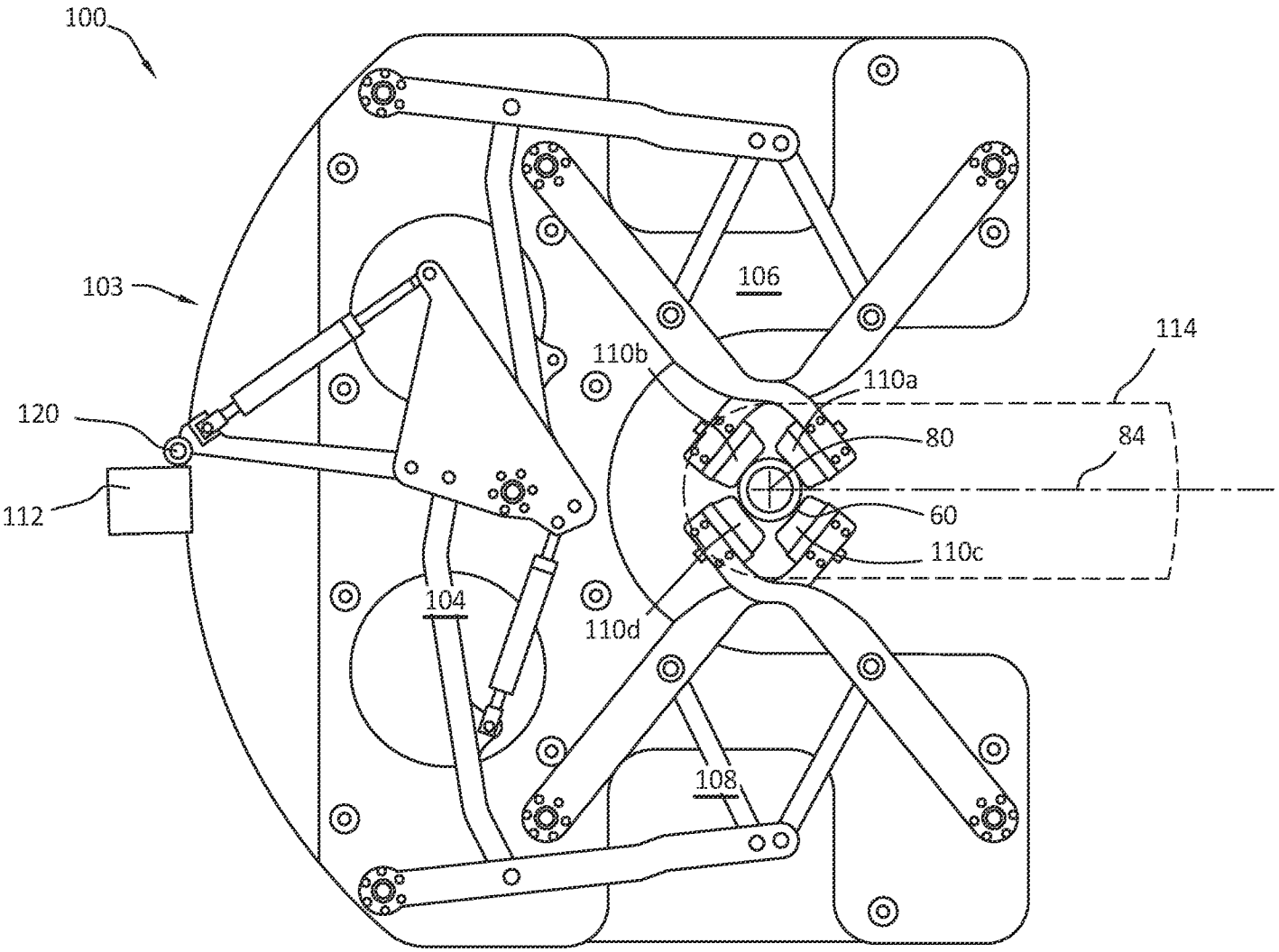

FIGS. 6A-6C are representative top views of the stabbing guide 100 mounted on the torque wrench 42 and rotated to various arc distances to operate the stabbing guide 100. FIGS. 6A-6C are similar to FIGS. 5A-5C in that the stabbing guide 100 is still rotated to activate the stabbing guide 100, but the FIGS. 6A-6C keep the stabbing guide in a common orientation in reference to the figures, with the stop 112 shown moved relative to the stabbing guide 100 to illustrate the counterclockwise rotation of the gripper assembly 46. Also, the top plate of the stabbing guide is hidden to illustrate the operation of the linkage assembly 103, and the sub-assemblies 104, 106, 108.

FIG. 6A shows the stabbing guide 100 beginning to engage the engaging element 120 with the stop 112. The guide elements 110*a-d* have not yet begun to move radially inward toward the center axis 80. A small diameter tubular 60 is shown positioned in the opening 114 and aligned with the center axis 80 for reference. The opening 114 of the gripper assembly 46 is shown with a dashed outline to indicate its relative position to the stabbing guide 100, but the gripper assembly 46 is omitted for clarity.

FIG. 6B shows the engaging element 120 engaged with the stop 112 and the gripper assembly 46 rotated past the engagement of the engaging element 120. The guide elements 110*a-d* have been moved (via the linkage assembly 103) radially inward toward the center axis 80. Comparing the position of the linkage assembly 103 components in FIG. 6B to their positions in FIG. 6A, the movement of the linkage assembly 103 components can be seen as the engaging element drives the linkage assembly 103. The biasing device 125 can be compressed as the drive plate 123 rotates in a clockwise direction. The energy stored in the biasing device 125 can be used to rotate the drive plate 123 back to its initial at-rest position, as seen in FIG. 6A. A small diameter tubular 60 is shown positioned in the opening 114 and aligned with the center axis 80 for reference.

FIG. 6C shows the engaging element 120 engaged with the stop 112 and the gripper assembly 46 rotated further past the engagement of the engaging element 120. The guide elements 110*a-d* have been moved (via the linkage assembly 103) radially inward toward the center axis 80 to engage the small diameter tubular 60. Comparing the position of the linkage assembly 103 components in FIG. 6C to their positions in FIGS. 6A, 6B, the movement of the linkage assembly 103 components can be seen as the engaging element drives the linkage assembly 103. The biasing device 125 can be compressed as the drive plate 123 rotates in a clockwise direction. The energy stored in the biasing device 125 can be used to rotate the drive plate 123 back to its initial at-rest position, as seen in FIG. 6A. A small diameter tubular 60 is shown positioned in the opening 114 and aligned with the center axis 80 for reference.

Figure 7C:
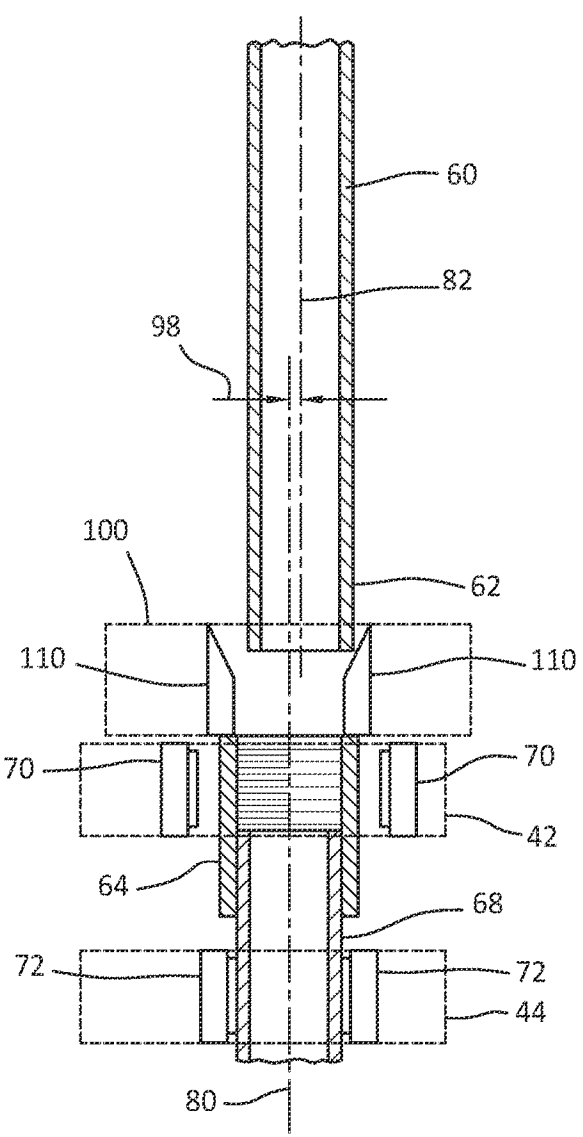
FIG. 7C is a representative partial cross-sectional simplified view of a stabbing guide and a roughneck being used to align a tubular (e.g., a casing pipe) to a stickup at well center, in accordance with certain embodiments.
Figure 7B:
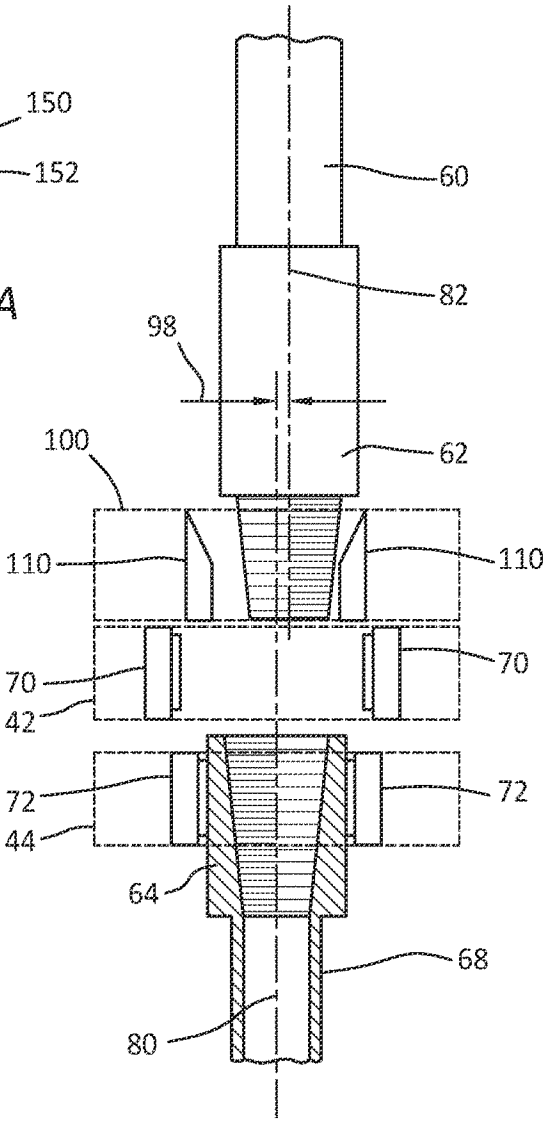
FIG. 7B is a representative partial cross-sectional simplified view of a stabbing guide and a roughneck being used to align a tubular (e.g., a drill pipe) to a stickup at well center, in accordance with certain embodiments.
Figure 7A:
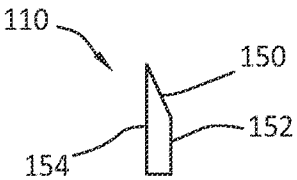
FIG. 7A is a representative side view of a guide element of the stabbing guide, in accordance with certain embodiments.

FIG. 7A is a representative side view of a guide element 110 (e.g., guide elements 110*a-d*) of the stabbing guide 100. Each guide element 110 can include an attachment surface 154 that can be used to attach the guide element 110 to a component of the linkage assembly 103 (e.g., links 136, 138, 146, 148). Each guide element 110 can include an engagement surface 152 that can be used to engage an outer surface of a tubular 60 to nudge the tubular 60 toward alignment with the center axis 80. Each guide element 110 can include an inclined surface 150 that can be tapered away from the center axis 80 and away from the engagement surface 152 such that the thinner portion of the guide element 110 is at the top of the guide element 110 and the thicker portion of the guide element 110 is toward the bottom of the guide element 110. Therefore, if a tubular 60 engages the inclined surface 150, it will be nudged toward the center axis 80 as the tubular moves vertically down the inclined surface 150.

FIG. 7B is a representative partial cross-sectional simplified view of a stabbing guide 100 on an associated roughneck 40 (with torque wrench 42 and backup tong 44) being used to align a tubular 60 (e.g., a drill pipe) to a stickup 68 at well center 18. The tubular 60 can be positioned above stickup 68 on the rig floor 16, but the tubular 60 can be offset by a radial offset 98 that refers to a radial offset between the center axis 82 of the tubular 60 and the center axis 80 of the tubular string 66 (or stickup 68). The stickup 68 can be held at well center by slips (not shown) on the rig floor 16 and by grippers 72 of the gripper assembly 48 of the backup tong 44. Only two grippers 72 are shown, but more grippers 72 can be used by the backup tong 44 to hold and align the stickup 68 with the center of the backup tong 44 opening 118 (see FIG. 2A) and the center axis 80 of the stickup 68.

As the tubular 60 is vertically lowered toward the stickup 68, the inclined surfaces of the guide elements 110 can act to align the tubular 60 to a center of the stabbing guide 100 which can be aligned with the center axis 80 of the stickup 68. The guide elements 110 can be positioned such that they can align the center axis 82 of the tubular 60 to the center axis 80 of the stickup 68 to provide better accuracy in stabbing the pin end 62 of the tubular 60 into the box end 64 of the stickup 68. Once the stabbing guide 100 substantially aligns the tubular 60 with the stickup 68, then the pin end 62 can be stabbed into the box end 64 and the ends threaded together to form a joint. The grippers 70 of the torque wrench 42 can then be used to apply the desired torque to makeup the joint into a joint connection. Only two grippers 70 are shown, but more grippers 70 can be used by the torque wrench 42 to hold and torque the tubular onto the stickup 68.

FIG. 7C is a representative partial cross-sectional simplified view of a stabbing guide 100 on an associated roughneck 40 (with torque wrench 42 and backup tong 44) being used to align a tubular 60 (e.g., a casing pipe) to a stickup 68 at well center 18. The tubular 60 can be positioned above stickup 68 on the rig floor 16, but the tubular 60 can be offset by a radial offset 98 that refers to a radial offset between the center axis 82 of the tubular 60 and the center axis 80 of the tubular string 66 (or stickup up 68). The stickup 68 can be held at well center by slips (not shown) on the rig floor 16 and by grippers 72 of the gripper assembly 48 of the backup tong 44. Only two grippers 72 are shown, but more grippers 72 can be used by the backup tong 44 to hold and align the stickup 68 with the center of the backup tong 44 opening 118 (see FIG. 2A) and the center axis 80 of the stickup 68.

As the tubular 60 is vertically lowered toward the stickup 68, the inclined surfaces of the guide elements 110 can act to align the tubular 60 to a center of the stabbing guide 100 which can be aligned with the center axis 80 of the stickup 68. The guide elements 110 can be positioned such that they can align the center axis 82 of the tubular 60 to the center axis 80 of the stickup 68 to provide better accuracy in stabbing the pin end 62 of the tubular 60 into the box end 64 of the stickup 68. Once the stabbing guide 100 substantially aligns the tubular 60 with the stickup 68, then the pin end 62 can be stabbed into the box end 64 and the ends threaded together to form a joint. The grippers 70 of the torque wrench 42 can then be used to apply the desired torque to makeup the joint into a joint connection. Only two grippers 70 are shown, but more grippers 70 can be used by the torque wrench 42 to hold and torque the tubular onto the stickup 68.

Figure 8C:
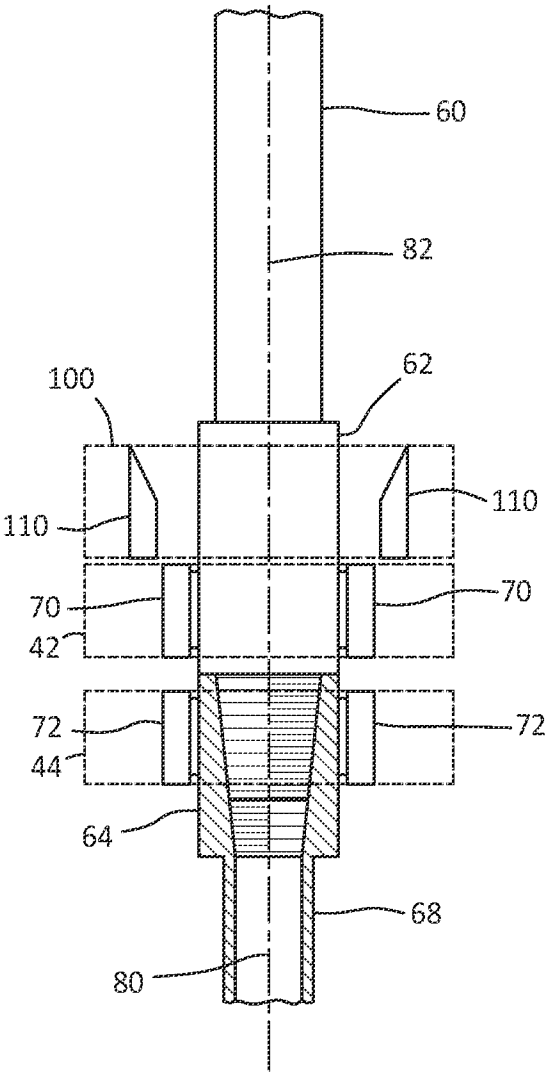
FIGS. 8A-8C are representative partial cross-sectional simplified views of a stabbing guide and a roughneck being used to align a tubular (e.g., a drill pipe) that is vertically lowered through the stabbing guide to a stickup at well center, in accordance with certain embodiments.
Figure 8B:
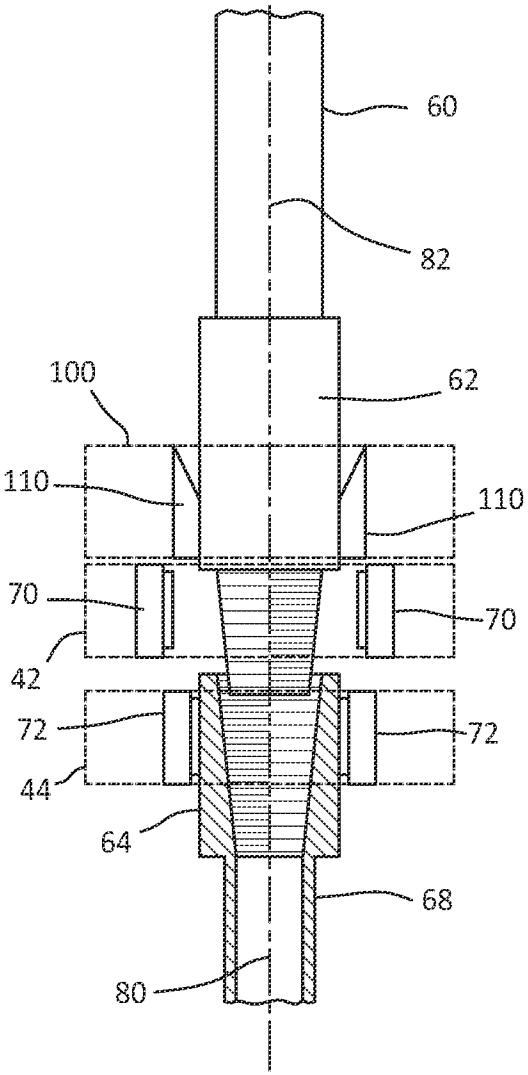
Figure 8A:
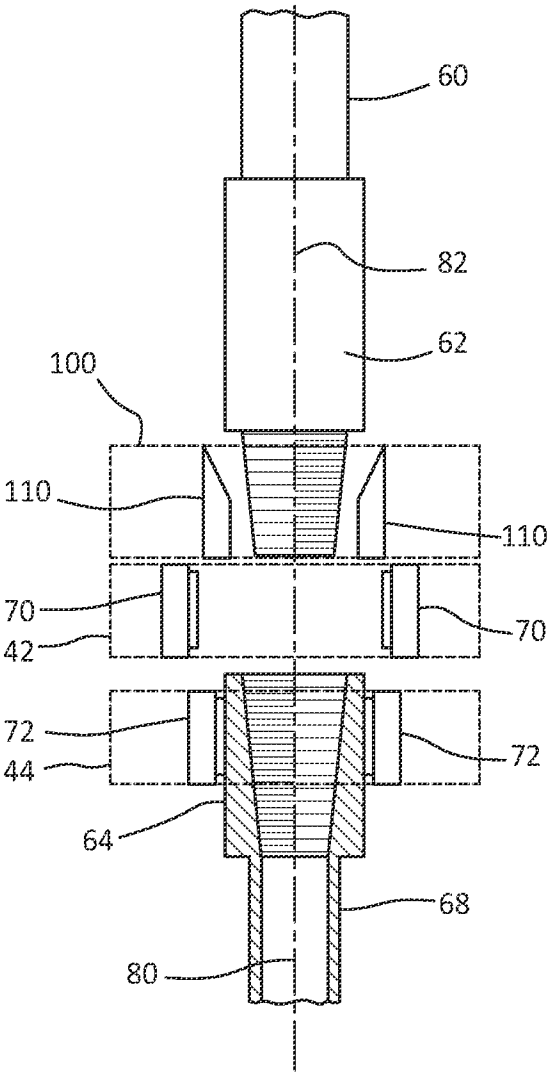
Figure 9C:
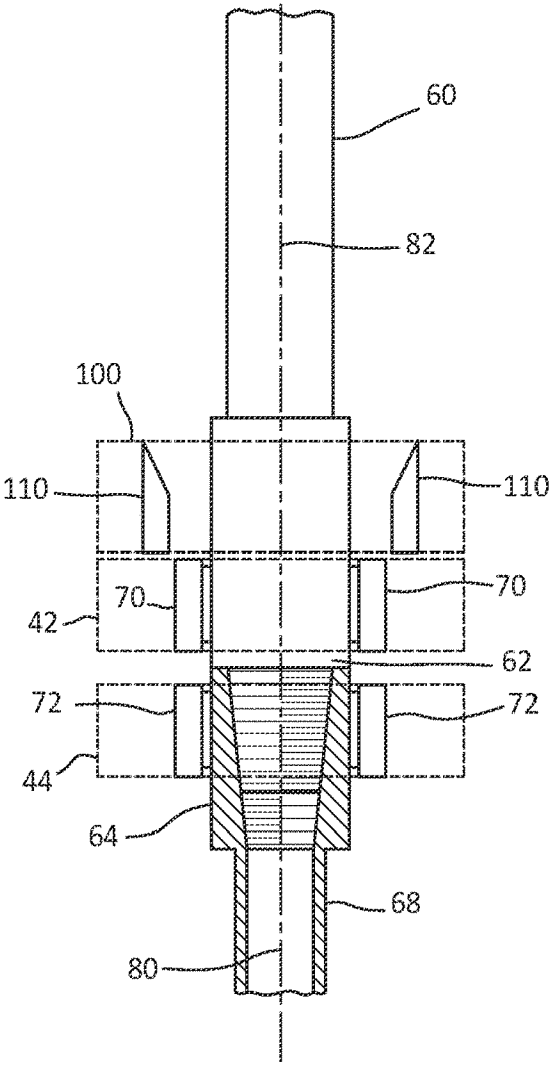
FIGS. 9A-9C are representative partial cross-sectional simplified views of a stabbing guide and a roughneck being used to align a tubular (e.g., a drill pipe) that is horizontally moved into the stabbing guide through a side of the torque wrench and then lowered to a stickup at well center, in accordance with certain embodiments.
Figure 9B:
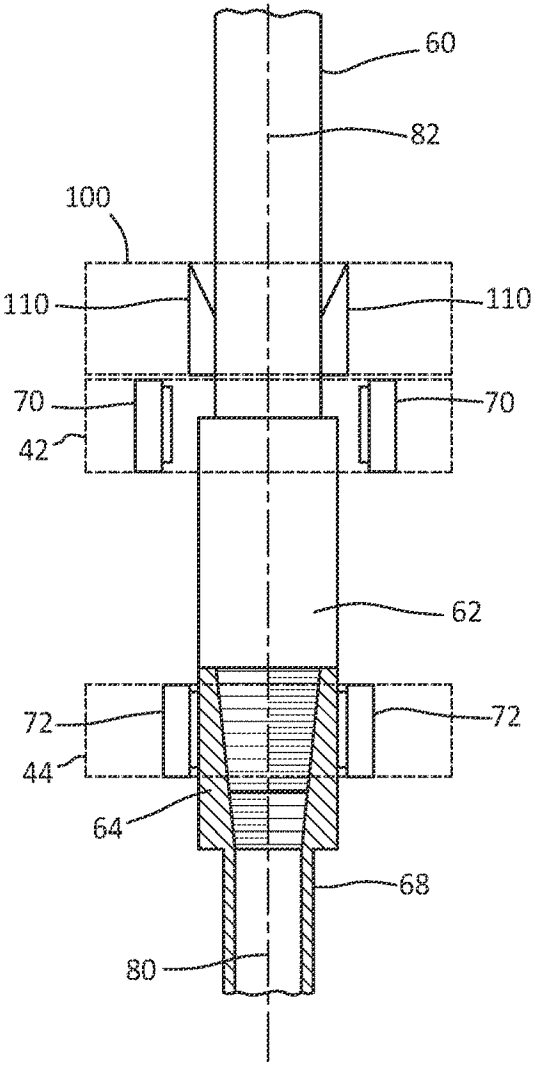
Figure 9A:
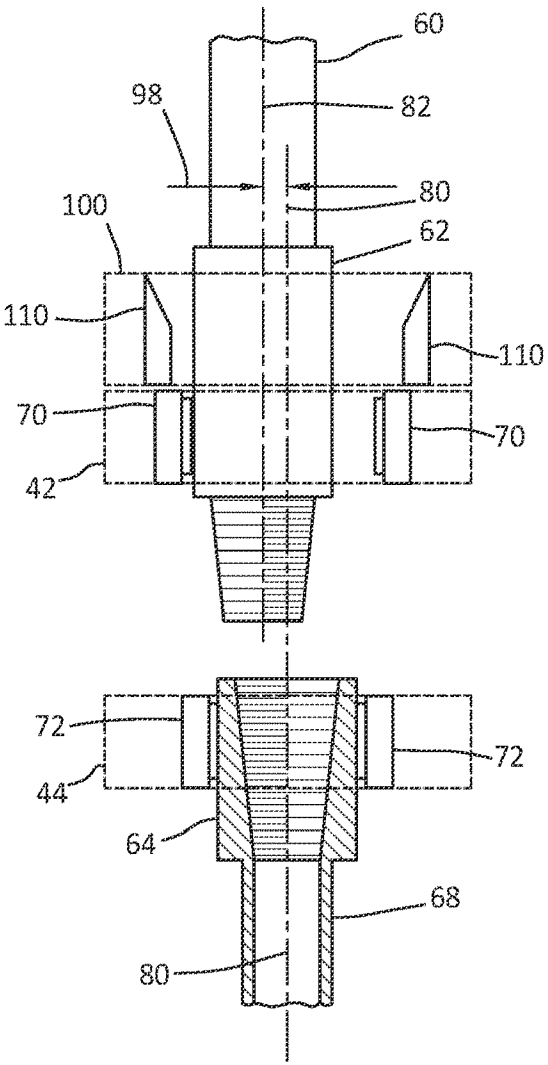
Figure 10C:
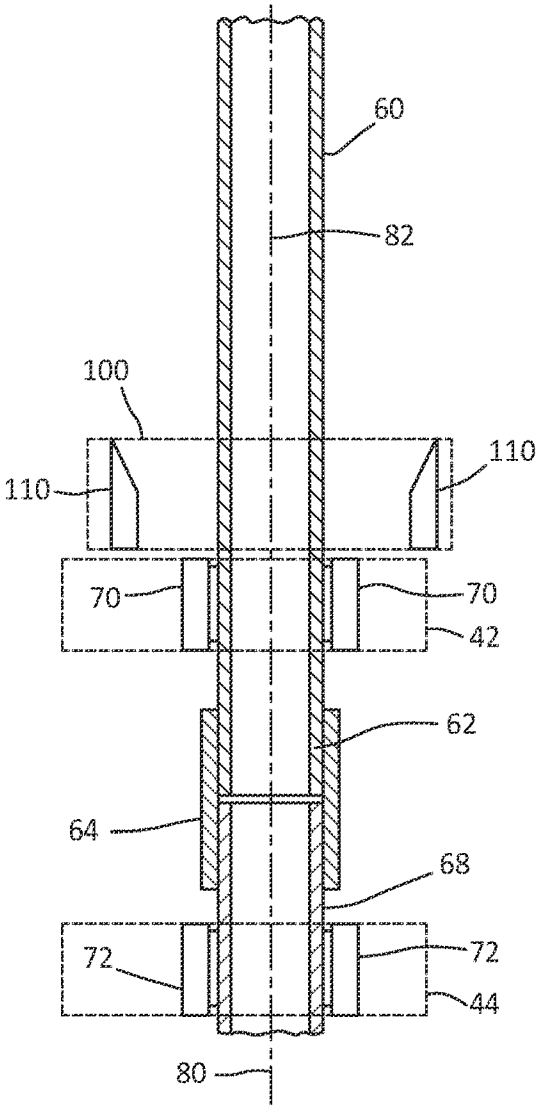
FIGS. 10A-10C are representative partial cross-sectional simplified views of a stabbing guide and a roughneck being used to align a tubular (e.g., a casing pipe) that is vertically lowered through the stabbing guide to a stickup at well center, in accordance with certain embodiments.
Figure 10B:
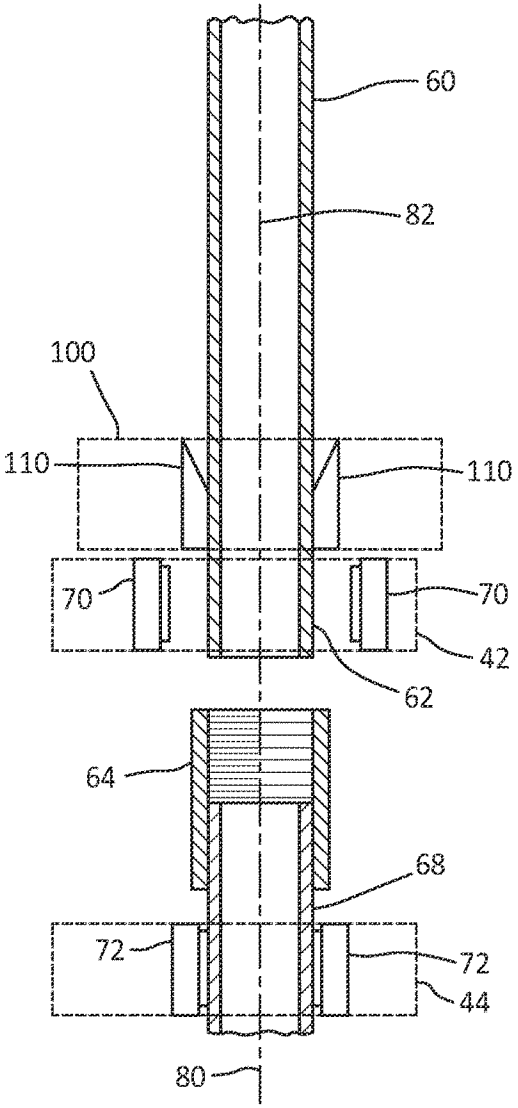
Figure 10A:
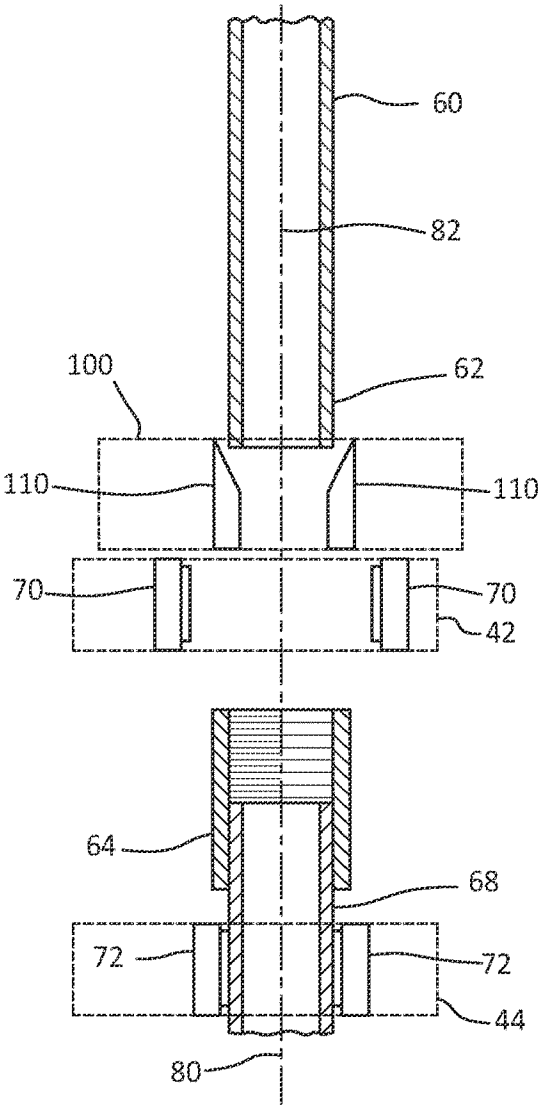
Figure 11C:
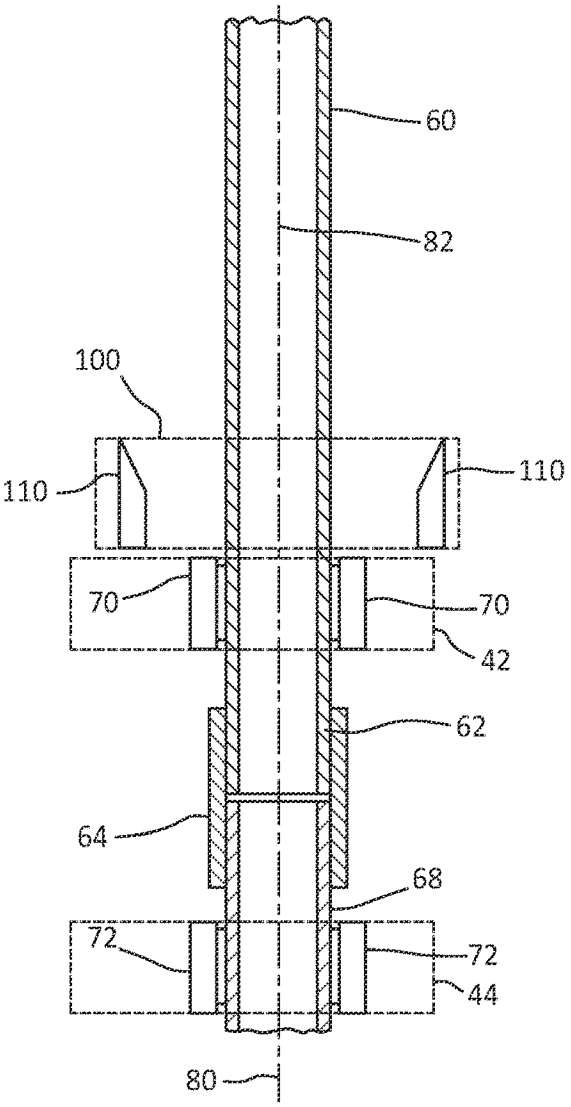
FIGS. 11A-11C are representative partial cross-sectional simplified views of a stabbing guide and a roughneck being used to align a tubular (e.g., a casing pipe) that is horizontally moved into the stabbing guide through a side of the torque wrench and then lowered to a stickup at well center, in accordance with certain embodiments.

FIGS. 8A-11C show various sequences of aligning and stabbing tubulars 60 into a stickup 68 at well center. FIGS. 8A-8C show a sequence of vertically lowering a tubular 60 (e.g., a drill pipe) into the stabbing guide 100, aligning the tubular 60 to the stickup 68 (e.g., a drill string), and stabbing the tubular 60 into the stickup 68. FIGS. 9A-9C show a sequence of moving a tubular (e.g., a drill pipe) laterally through a side of the torque wrench 42 and the stabbing guide 100, aligning the tubular 60 to the stickup 68 (e.g., a drill string), and stabbing the tubular 60 into the stickup 68. FIGS. 10A-10C show a sequence of vertically lowering a tubular 60 (e.g., a casing pipe) into the stabbing guide 100, aligning the tubular 60 to the stickup 68 (e.g., a casing string), and stabbing the tubular 60 into the stickup 68. FIGS. 11A-11C show a sequence of moving a tubular (e.g., a casing pipe) laterally through a side of the torque wrench 42 and the stabbing guide 100, aligning the tubular 60 to the stickup 68 (e.g., a casing string), and stabbing the tubular 60 into the stickup 68.

Referring to FIG. 8A, the backup tong 44 has engaged the stickup 68 with grippers 72 at the box end 64. The torque wrench 42 is positioned at a vertical spacing from the backup tong 44 and the stickup 68 such that when the tubular 60 (e.g., a drill pipe) is stabbed into the stickup 68, the torque wrench 42 is at the correct vertical position to begin torqueing the joint without having to move vertically. It is not a requirement that the torque wrench 42 not move vertically before torqueing the joint, but it could be more efficient than performing one or more steps before torqueing the joint.

In this example, the tubular 60 can be vertically lowered into the stabbing guide 100 which has been set such that the diameter of the circle of the guide elements 110 is slightly smaller than the outer diameter of the pin end 62 of the tubular 60. For example, the diameter of the circle of the guide elements 110 can be set to the outer diameter of the body of the tubular above the pin end 62. The axis 82 of the tubular 60 is shown aligned with the axis 80 of the stickup 68, but it should be understood that the axis 82 of the tubular 60 can be offset by an offset 98 as in the other sequences (i.e., FIG. 9A) and the stabbing guide 100 can still urge the axis 82 into alignment with the axis 80, as the tubular 60 is vertically lowered into and through the stabbing guide 100. The grippers 70 of the torque wrench 42 are retracted away from the tubular 60.

Referring to FIG. 8B, the tubular 60 has forced the guide elements 110, by the tubular 60, to a larger diameter that matches the outer diameter of pin end 62. The guide elements 110 urge the center axis 82 of the tubular 60 to align with the center axis 80 of the stickup 68. The grippers 70 of the torque wrench 42 remain retracted away from the tubular 60. Now that the tubular 60 is aligned with the stickup 68, the tubular 60 can be vertically lowered into engagement with the stickup 68, with a pipe handler (pipe handler 20, top drive, etc.) that can spin the tubular 60 into the stickup 68 to form a joint.

Referring to FIG. 8C, the pin end 62 of the tubular 60 has been spun into the box end 64 of the stickup 68. The grippers 70 of the torque wrench 42 are extended into engagement with the pin end 62, and the torque wrench 42 has rotated clockwise enough in the torqueing mode to retract the guide elements 110 away from the tubular 60. When the joint is torqued and made up into a joint connection, the torque wrench 42 can retract the grippers 70 and rotate the opening 114 to align with opening 116 so the iron roughneck 40 can move away from well center.

Referring to FIG. 9A, the backup tong 44 has engaged the stickup 68 with grippers 72 at the box end 64. The torque wrench 42 is positioned at a vertical spacing from the backup tong 44 and the stickup 68 to allow the tubular 60 (e.g., a drill pipe) to be laterally moved into the torque wrench 42 (and the stabbing guide 100) through the opening 116 of the body 45 and opening 114 of the gripper assembly 46. As the tubular 60 is positioned in the opening 114, near the center axis 80, the center axis 82 of the tubular 60 may be radially offset 98 from the center axis 80 of the stickup 68. The stabbing guide 100 can be used to align the tubular 60 with the stickup 68 prior to vertically lowering the tubular 60 into engagement with the stickup 68.

In this example, the stabbing guide 100 can move the guide elements 110 radially inward to close around the tubular 60 and urge the center axis 82 of the tubular 60 into alignment with the center axis 80 of the stickup 68. The gripper assembly 46 of the torque wrench 42 can be rotated a desired distance that would cause the guide elements 110 to form a circle that would be the size of the outer diameter of the body of the tubular 60 or smaller, with the body being a reduced outer diameter portion of the tubular 60 when compared to the outer diameter of the pin end 62 of the tubular 60. However, in this example, while moving the guide elements 110 radially inward, the larger diameter of the pin end 62 engages the guide elements 110 before forming a circle that is equal to the reduced outer diameter of the body of the tubular 60.

Because of the biasing device 124, the gripper assembly 46, along with the stabbing guide 100, can be rotated the desired distance that would move the guide elements 110 to a circle with an inner diameter substantially equal to the outer diameter of the body of the tubular 60. The larger diameter pin end 62 causes the movement of the guide elements 110 to be halted before they can form the smaller diameter circle of the outer surface of the tubular body. The gripper assembly 46 can continue to rotate even after the guide elements 110 have engaged the pin end 62. The biasing device 124 allows for further rotation of the gripper assembly 46 while allowing the drive plate 123 to not rotate any more after the guide elements 110 engage the pin end 62.

When the tubular 60 is vertically lowered such that the guide elements 110 are no longer engaged with the pin end 62 and are axially positioned with a portion of the tubular body, the guide elements 110 can self-adjust to engage the smaller diameter of the tubular body without further rotation of the gripper assembly 46. Therefore, the gripper assembly 46 may not be rotating when the guide elements 110 self-adjust (i.e., move radially inward from the outer diameter of the pin end to the smaller outer diameter of the tubular body) to the smaller outer diameter of the tubular body. The self-adjustment can be caused by the biasing device 124 driving rotation of the drive plate 123 when the larger diameter pin end 62 passes out of the stabbing guide 100 and no longer halts inward radial movement of the guide elements 110 which then can move radially inward to engage the tubular body.

However, it should be understood that the gripper assembly 46 can be moved to first configure the guide elements 110 around the larger diameter pin end 62 and then rotate more to configure the guide elements 110 around the smaller diameter of the tubular body, without having the stabbing guide 100 to self-adjust the guide elements to the smaller diameter. The grippers 70 of the torque wrench 42 are retracted away from the tubular 60 while the tubular 60 is being aligned and stabbed into the stickup 68.

Referring to FIG. 9B, with the guide elements 110 engaging the tubular 60 (at the pin end or at the tubular body section), the center axis 82 of the tubular 60 can be aligned with the center axis 80 of the stickup 68. The tubular 60 can then be vertically lowered to stab the pin end 62 of the tubular 60 into the box end 64 of the stickup 68, and then thread the pin end 62 into the box end 64.

Referring to FIG. 9C, the torque wrench 42 (along with the stabbing guide 100) can be vertically moved to align the torque wrench 42 with the pin end 62 and engage the grippers 70 with the pin end 62. Before engaging the grippers 70, the gripper assembly 46 can be rotated to move the guide elements 110 radially away from the center axis 80, since engagement of the guide elements 110 is no longer needed after the pin end 62 is stabbed into the box end 64. The grippers 70 of the torque wrench 42 can be extended into engagement with the pin end 62, and the torque wrench 42 can be rotated clockwise to apply the desired torque to the joint to makeup the joint connection.

Referring to FIG. 10A, the backup tong 44 has engaged the stickup 68 with grippers 72 at the box end 64. The torque wrench 42 is positioned at a vertical spacing from the backup tong 44 and the stickup 68 such that when the tubular 60 (e.g., a casing pipe) is stabbed into the stickup 68, the torque wrench 42 is at the correct vertical position to begin torqueing the joint without having to move vertically. It is not a requirement that the torque wrench 42 not move vertically before torqueing the joint, but it could be more efficient than performing one or more steps before torqueing the joint. In this example, the tubular 60 can be vertically lowered into the stabbing guide 100 which has been set such that the diameter of the circle of the guide elements 110 is slightly smaller than the outer diameter of the pin end 62 of the tubular 60. The axis 82 of the tubular 60 is shown aligned with the axis 80 of the stickup 68, but it should be understood that the axis 82 of the tubular 60 can be offset by an offset 98 as in the other sequences (i.e., FIG. 11A) and the stabbing guide 100 can still urge the axis 82 into alignment with the axis 80, as the tubular 60 is vertically lowered into and through the stabbing guide 100. The grippers 70 of the torque wrench 42 are retracted away from the tubular 60.

Referring to FIG. 10B, the tubular 60 has forced the guide elements 110, by the tubular 60, to a larger diameter that matches the outer diameter of tubular 60. The guide elements 110 urge the center axis 82 of the tubular 60 to align with the center axis 80 of the stickup 68. The grippers 70 of the torque wrench 42 remain retracted away from the tubular 60. Now that the tubular 60 is aligned with the stickup 68, the tubular 60 can be vertically lowered into engagement with the stickup 68, with a pipe handler (pipe handler 20, top drive, etc.) that can spin the tubular 60 into the stickup 68 to form a joint.

Referring to FIG. 10C, the pin end 62 of the tubular 60 has been spun into the box end 64 of the stickup 68. The grippers 70 of the torque wrench 42 are extended into engagement with the pin end 62, and the torque wrench 42 has rotated clockwise enough in the torqueing mode to retract the guide elements 110 away from the tubular 60. When the joint is torqued and made up into a joint connection, the torque wrench 42 can retract the grippers 70 and rotate the opening 114 to align with opening 116 so the iron roughneck 40 can move away from well center.

Figure 11B:
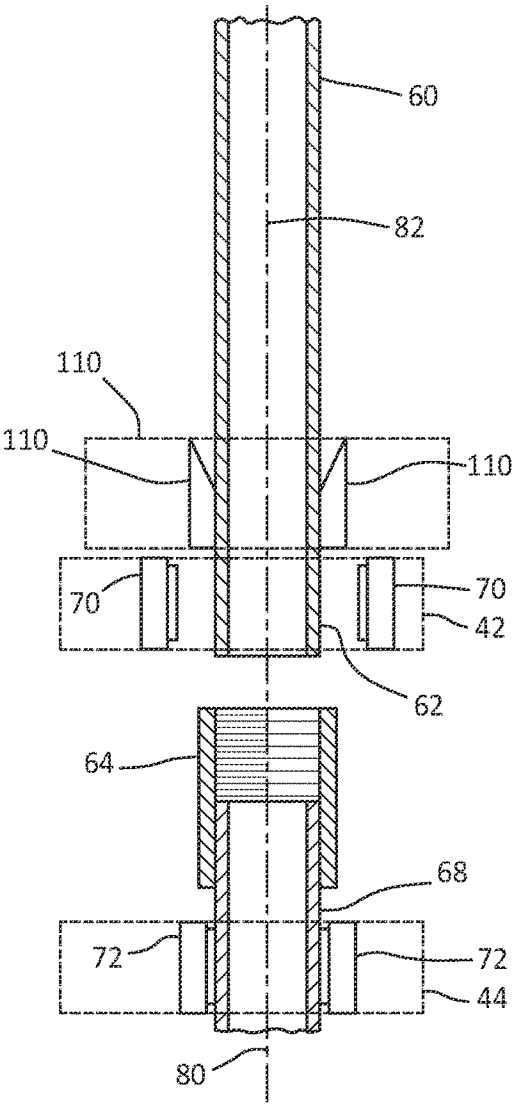
Figure 11A:
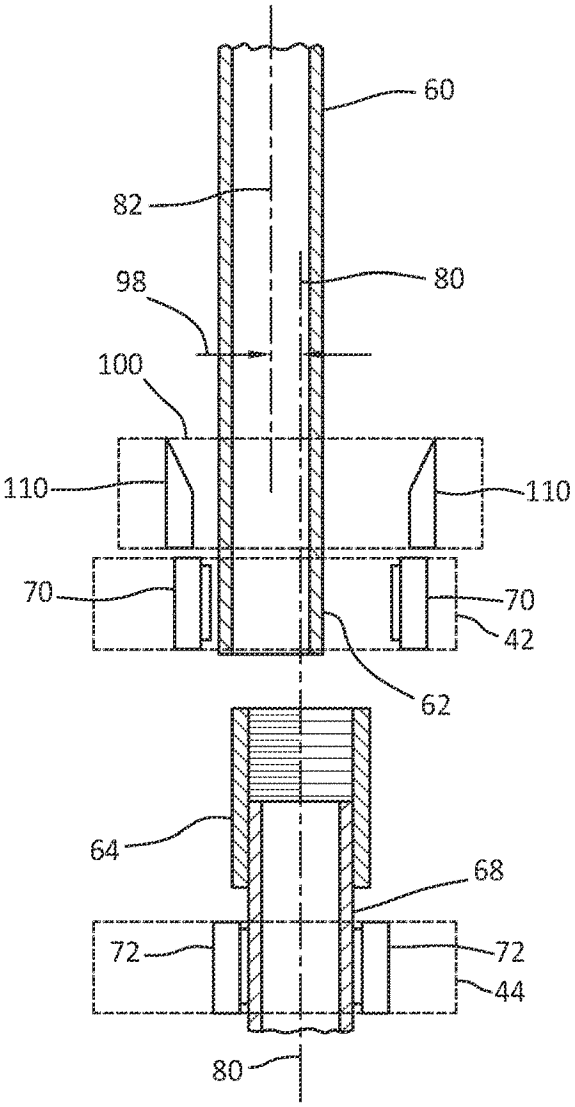

Referring to FIG. 11A, the backup tong 44 has engaged the stickup 68 with grippers 72 at the box end 64. The torque wrench 42 is positioned at a vertical spacing from the backup tong 44 and the stickup 68 to allow the tubular 60 (e.g., a casing pipe) to be laterally moved into the torque wrench 42 (and the stabbing guide 100) through the opening 116 of the body 45 and opening 114 of the gripper assembly 46. As the tubular 60 is positioned in the opening 114, near the center axis 80, the center axis 82 of the tubular 60 may be radially offset 98 from the center axis 80 of the stickup 68. The stabbing guide 100 can be used to align the tubular 60 with the stickup 68 prior to vertically lowering the tubular 60 into engagement with the stickup 68.

In this example, the stabbing guide 100 can move the guide elements 110 radially inward to close around the tubular 60 and urge the center axis 82 of the tubular 60 into alignment with the center axis 80 of the stickup 68. The tubular 60 can then be vertically lowered into engagement with the box end 64 and threaded into the box end 64 to form a joint between the tubular 60 and the stickup 68. The grippers 70 of the torque wrench 42 are retracted away from the tubular 60 while the tubular 60 is being aligned and stabbed into the stickup 68.

Referring to FIG. 11B, the guide elements 110 can engage the tubular 60, thereby aligning the center axis 82 of the tubular 60 with the center axis 80 of the stickup 68. The tubular 60 can then be vertically lowered to stab the pin end 62 of the tubular 60 into the box end 64 of the stickup 68, and then the pin end 62 can be threaded into the box end 64.

Referring to FIG. 11C, since the torque wrench 42 is already vertically positioned at a body portion of the tubular 60 (i.e., away from the box end 64 when joined to the pin end 62, which can be preferred when building a casing string 66), the torque wrench 42 can engage the grippers 70 with the tubular 60. Before engaging the grippers 70, the gripper assembly 46 can be rotated to move the guide elements 110 radially away from the center axis 80, since engagement of the guide elements 110 is no longer needed after the pin end 62 is stabbed into the box end 64. The grippers 70 of the torque wrench 42 can be extended into engagement with the tubular 60, and the torque wrench 42 can be rotated clockwise to apply the desired torque to the joint to makeup the joint connection.

Various Embodiments

Embodiment 1. A system for performing a subterranean operation; the system comprising:

- a stabbing guide comprising:
- a plurality of guide elements;
- an engaging element; and
- a linkage assembly that couples the plurality of guide elements to the engaging element; and wherein rotation of the engaging element relative to the plurality of guide elements drives the linkage assembly and, via the linkage assembly, moves the guide elements radially relative to a center axis of the stabbing guide.

Embodiment 2. The system of Embodiment 1, wherein the plurality of guide elements comprises three or more guide elements.

Embodiment 3. The system of Embodiment 1, wherein the plurality of guide elements substantially form a circle with each of the guide elements circumferentially spaced around a circumference of the circle, and with each of the guide elements circumferentially spaced apart from an adjacent one of the guide elements.

Embodiment 4. The system of Embodiment 3, wherein the circle has a first diameter when the plurality of guide elements are moved radially by the rotation of the engaging element, wherein the linkage assembly comprises a biasing device that is configured to allow a tubular to radially expand the plurality of guide elements to substantially form a circle with a second diameter that is larger than the first diameter.

Embodiment 5. The system of Embodiment 4, wherein the biasing device self-adjusts the plurality of guide elements back to the circle with the first diameter when the tubular is removed from the stabbing guide.

Embodiment 6. The system of Embodiment 3, wherein the stabbing guide is configured to receive a tubular with a first portion that is radially enlarged with a first outer diameter and a second portion that is radially reduced compared to the first portion, the second portion having a second outer diameter, and wherein a biasing device is configured to allow the first portion of the tubular to radially move the plurality of guide elements away from the center axis to substantially form a circle with a first diameter that is substantially equal to the first outer diameter.

Embodiment 7. The system of Embodiment 6, wherein the biasing device is configured to self-adjust the plurality of guide elements from a circle with the first diameter to a radially reduced circle with a second diameter when the first portion of the tubular moves out of the stabbing guide as the second portion of the tubular moves into the stabbing guide, and wherein the second diameter is substantially equal to the second outer diameter.

Embodiment 8. The system of Embodiment 1, wherein the linkage assembly comprises a first link and a second link, with the first link coupled between the engaging element and the second link, the second link coupled between the first link and one of the plurality of guide elements, and wherein rotation of the engaging element rotates the first link and the second link relative to the engaging element and the second link radially moves the one of the plurality of guide elements relative to the center axis of the stabbing guide.

Embodiment 9. The system of Embodiment 1, wherein the linkage assembly comprises a biasing device that urges the linkage assembly to an initial orientation when a rotation force applied to the engaging element is removed.

Embodiment 10. A system for performing a subterranean operation; the system comprising:

an iron roughneck comprising a torque wrench and a backup tong;

a stabbing guide comprising:

a plurality of guide elements;

an engaging element; and a linkage assembly that couples the plurality of guide elements to the engaging element; and wherein rotation of the torque wrench selectively engages the engaging element and rotates the engaging element relative to the plurality of guide elements, and wherein rotation of the engaging element drives the linkage assembly and, via the linkage assembly, moves the guide elements radially relative to a center axis of the stabbing guide.

Embodiment 11. The system of Embodiment 10, wherein rotation of the torque wrench in a first direction engages the engaging element with the torque wrench and moves, via the linkage assembly, the guide elements radially inward relative to a center axis of the stabbing guide.

Embodiment 12. The system of Embodiment 10, wherein rotation of the torque wrench in a second direction moves, via the linkage assembly, the guide elements radially outward relative to a center axis of the stabbing guide and disengages the engaging element from the torque wrench.

Embodiment 13. The system of Embodiment 10, wherein the backup tong is configured to grip a stickup at a well center, the stickup having a center axis that is aligned with the center axis of the stabbing guide, and wherein the torque wrench comprises a body rotationally fixed to the backup tong and gripper assembly portion that is rotationally coupled to the body.

Embodiment 14. The system of Embodiment 13, wherein the stabbing guide rotates with the gripper assembly, and wherein a stop is rotationally fixed to the body and selectively engages the engaging element when the gripper assembly rotates an activation arc distance.

Embodiment 15. The system of Embodiment 14, wherein rotation of the gripper assembly past the activation arc distance causes the engaging element to rotate and, via the linkage assembly, radially moves the plurality of guide elements relative to the center axis of the stabbing guide.

Embodiment 16. The system of Embodiment 15, wherein the plurality of guide elements are configured to align a center axis of a tubular with the center axis of the stickup as the plurality of guide elements move radially inward toward the center axis of the stabbing guide.

Embodiment 17. A method for performing a subterranean operation, the method comprising:

moving a tubular into an opening in a torque wrench of an iron roughneck;

rotating the torque wrench, thereby activating a stabbing guide;

engaging the tubular with a plurality of guide elements of the stabbing guide in response to rotating the torque wrench; and moving the plurality of guide elements radially inward toward a center axis of the stabbing guide a radial distance that is proportional to a distance of rotation of the torque wrench.

Embodiment 18. The method of Embodiment 17, further comprising:

moving the iron roughneck to well center; and gripping a stickup at the well center with a backup tong of the iron roughneck, wherein moving the plurality of guide elements radially inward aligns a center axis of the tubular with a center axis of the stickup.

Embodiment 19. The method of Embodiment 18, further comprising:

stabbing the tubular into the stickup at the well center; and spinning in the tubular into the stickup to form a joint in a tubular string.

Embodiment 20. The method of Embodiment 17, wherein moving the tubular into the opening comprises vertically lowering the tubular through the stabbing guide and into the opening of the torque wrench.

Embodiment 21. The method of Embodiment 20, wherein a pin end of the tubular has a first outer diameter that is larger than a second outer diameter of a body portion of the tubular, and wherein vertically lowering the pin end into the stabbing guide moves the plurality of guide elements radially away from the center axis of the stabbing guide, thereby compressing a biasing device and substantially forming a circle with a first diameter that is substantially equal to the first outer diameter.

Embodiment 22. The method of Embodiment 21, wherein moving the plurality of guide elements radially away from the center axis of the stabbing guide occurs while the torque wrench remains stationary.

Embodiment 23. The method of Embodiment 21, wherein vertically lowering the pin end through the stabbing guide while lowering the body portion of the tubular into the stabbing guide allows the biasing device to extend and self-adjust the plurality of guide elements, thereby moving the plurality of guide elements radially toward the center axis of the stabbing guide, and substantially forming a circle with a second diameter that is substantially equal to the second outer diameter.

While the present disclosure may be susceptible to various modifications and alternative forms, specific embodiments have been shown by way of example in the drawings and tables and have been described in detail herein. However, it should be understood that the embodiments are not intended to be limited to the particular forms disclosed. Rather, the disclosure is to cover all modifications, equivalents, and alternatives falling within the spirit and scope of the disclosure as defined by the following appended claims. Further, although individual embodiments are discussed herein, the disclosure is intended to cover all combinations of these embodiments.

The invention claimed is:

1. A system for performing a subterranean operation; the system comprising:
- a stop; and
- a stabbing guide comprising:
  - a plurality of guide elements;
  - an engaging element; and
  - a linkage assembly that couples the plurality of guide elements to the engaging element; and
- wherein rotation of the stop about a center axis of the stabbing guide selectively engages the engaging element rotates the engaging element relative to the plurality of guide elements drives the linkage assembly and, via the linkage assembly, moves the guide elements radially relative to the center axis of the stabbing guide.

2. The system of claim 1, wherein the plurality of guide elements comprises three or more guide elements.

3. The system of claim 1, wherein the plurality of guide elements substantially form a circle with each of the guide elements circumferentially spaced around a circumference of the circle, and with each of the guide elements circumferentially spaced apart from an adjacent one of the guide elements.

4. The system of claim 3, wherein the circle has a first diameter when the plurality of guide elements are moved radially by the rotation of the engaging element, wherein the linkage assembly comprises a biasing device that is configured to allow a tubular to radially expand the plurality of guide elements to substantially form a circle with a second diameter that is larger than the first diameter.

5. The system of claim 4, wherein the biasing device self-adjusts the plurality of guide elements back to the circle with the first diameter when the tubular is removed from the stabbing guide.

6. The system of claim 3, wherein the stabbing guide is configured to receive a tubular with a first portion that is radially enlarged with a first outer diameter and a second portion that is radially reduced compared to the first portion, the second portion having a second outer diameter, and wherein a biasing device is configured to allow the first portion of the tubular to radially move the plurality of guide elements away from the center axis to substantially form a circle with a first diameter that is substantially equal to the first outer diameter.

7. A system for performing a subterranean operation; the system comprising:
- an iron roughneck comprising a torque wrench and a backup tong;
- a stabbing guide comprising:
  - a plurality of guide elements;
  - an engaging element; and
  - a linkage assembly that couples the plurality of guide elements to the engaging element; and
- wherein rotation of the torque wrench selectively engages the engaging element and rotates the engaging element relative to the plurality of guide elements, and wherein rotation of the engaging element drives the linkage assembly and, via the linkage assembly, moves the guide elements radially relative to a center axis of the stabbing guide.

8. The system of claim 7, wherein rotation of the torque wrench in a first direction engages the engaging element with the torque wrench and moves, via the linkage assembly, the guide elements radially inward relative to a center axis of the stabbing guide.

9. The system of claim 7, wherein rotation of the torque wrench in a second direction moves, via the linkage assembly, the guide elements radially outward relative to a center axis of the stabbing guide and disengages the engaging element from the torque wrench.

10. The system of claim 7, wherein the backup tong is configured to grip a stickup at a well center, the stickup having a center axis that is aligned with the center axis of the stabbing guide, and wherein the torque wrench comprises a body rotationally fixed to the backup tong, and gripper assembly portion that is rotationally coupled to the body.

11. The system of claim 10, wherein the stabbing guide rotates with the gripper assembly, and wherein a stop is rotationally fixed to the body and selectively engages the engaging element when the gripper assembly rotates an activation arc distance.

12. The system of claim 11, wherein rotation of the gripper assembly past the activation arc distance causes the engaging element to rotate and, via the linkage assembly, radially moves the plurality of guide elements relative to the center axis of the stabbing guide.

13. The system of claim 12, wherein the plurality of guide elements are configured to align a center axis of a tubular with the center axis of the stickup as the plurality of guide elements move radially inward toward the center axis of the stabbing guide.

14. A method for performing a subterranean operation, the method comprising:
- moving a tubular into an opening in a torque wrench of an iron roughneck;
- rotating the torque wrench, thereby activating a stabbing guide;

engaging the tubular with a plurality of guide elements of the stabbing guide in response to rotating the torque wrench; and moving the plurality of guide elements radially inward toward a center axis of the stabbing guide a radial distance that is proportional to a distance of rotation of the torque wrench.

15. The method of claim 14, further comprising:

moving the iron roughneck to well center; and gripping a stickup at the well center with a backup tong of the iron roughneck, wherein moving the plurality of guide elements radially inward aligns a center axis of the tubular with a center axis of the stickup.

16. The method of claim 15, further comprising:

stabbing the tubular into the stickup at the well center; and spinning in the tubular into the stickup to form a joint in a tubular string.

17. The method of claim 14, wherein moving the tubular into the opening comprises vertically lowering the tubular through the stabbing guide and into the opening of the torque wrench.

18. The method of claim 17, wherein a pin end of the tubular has a first outer diameter that is larger than a second outer diameter of a body portion of the tubular, and wherein vertically lowering the pin end into the stabbing guide moves the plurality of guide elements radially away from the center axis of the stabbing guide, thereby compressing a biasing device and substantially forming a circle with a first diameter that is substantially equal to the first outer diameter.

19. The method of claim 18, wherein moving the plurality of guide elements radially away from the center axis of the stabbing guide occurs while the torque wrench remains stationary.

20. The method of claim 18, wherein vertically lowering the pin end through the stabbing guide while lowering the body portion of the tubular into the stabbing guide allows the biasing device to extend and self-adjust the plurality of guide elements, thereby moving the plurality of guide elements radially toward the center axis of the stabbing guide, and substantially forming a circle with a second diameter that is substantially equal to the second outer diameter.

* * * * *